US010892536B2

(12) United States Patent
Fan et al.

(10) Patent No.: US 10,892,536 B2
(45) Date of Patent: Jan. 12, 2021

(54) WAVEGUIDES AND TRANSMISSION LINES IN GAPS BETWEEN PARALLEL CONDUCTING SURFACES

(71) Applicant: GAPWAVES AB, Gothenburg (SE)

(72) Inventors: Fangfang Fan, Gothenburg (SE); Jian Yang, Gothenburg (SE)

(73) Assignee: GAPWAVES AB, Gothenburg (SE)

( * ) Notice: Subject to any disclaimer, the term of this patent is extended or adjusted under 35 U.S.C. 154(b) by 0 days.

(21) Appl. No.: 15/761,406

(22) PCT Filed: Sep. 21, 2016

(86) PCT No.: PCT/EP2016/072409

§ 371 (c)(1),
(2) Date: Mar. 19, 2018

(87) PCT Pub. No.: WO2017/050817

PCT Pub. Date: Mar. 30, 2017

(65) Prior Publication Data

US 2018/0269557 A1 Sep. 20, 2018

(30) Foreign Application Priority Data

Sep. 24, 2015 (EP) ..... 15186666

(51) Int. Cl.
*H01P 3/123* (2006.01)
*H01P 5/12* (2006.01)
(Continued)

(52) U.S. Cl.
CPC ..... *H01P 3/123* (2013.01); *H01P 1/2005* (2013.01); *H01P 1/2088* (2013.01); *H01P 3/121* (2013.01);
(Continued)

(58) Field of Classification Search
CPC ..... H01P 3/12–14; H01P 1/2005; H01P 1/207–2088
See application file for complete search history.

(56) References Cited

U.S. PATENT DOCUMENTS 3,046,503 A * 7/1962 Cohn ..... H01P 1/211 333/210
3,271,706 A * 9/1966 Rooney ..... H01P 1/211 333/210
(Continued)

FOREIGN PATENT DOCUMENTS

CN 102160236 A 8/2011
GB 1377742 A 12/1974
(Continued)

OTHER PUBLICATIONS

International Search Report dated Feb. 2, 2017 for International Application No. PCT/EP2016/072409 entitled "Waveguides and Transmission Lines in Gaps Between Parallel Conducting Surfaces".
(Continued)

*Primary Examiner* — Dean O Takaoka
*Assistant Examiner* — Alan Wong
(74) *Attorney, Agent, or Firm* — Hamilton, Brook, Smith & Reynolds, P.C.

(57) ABSTRACT

A microwave device is based on gap waveguide technology, and comprises two conducting layers (101, 102) arranged with a gap there between, and protruding elements (103, 104) arranged in a periodically or quasi-periodically pattern and fixedly connected to at least one of said conducting layers, thereby forming a texture to stop wave propagation in a frequency band of operation in other directions than along intended waveguiding paths. Sets of complementary protruding elements are either each formed in said pattern and arranged in alignment and overlying each other, the
(Continued)

complementary protruding elements of each set forming part of the full length of each protruding element of the pattern, or the sets of complementary protruding elements are arranged in an offset complementary arrangement, the protruding elements of one set thereby being arranged in between the protruding elements of the other set.

23 Claims, 12 Drawing Sheets

(51) Int. Cl.

| | |
|---|---|
| ***H01P 1/20*** | (2006.01) |
| ***H01P 3/12*** | (2006.01) |
| ***H01P 1/208*** | (2006.01) |
| ***H01P 11/00*** | (2006.01) |
| ***H01Q 1/50*** | (2006.01) |
| ***H01Q 13/10*** | (2006.01) |

(52) U.S. Cl.
CPC ..... *H01P 5/12* (2013.01); *H01P 11/002* (2013.01); *H01Q 1/50* (2013.01); *H01Q 13/106* (2013.01)

(56) References Cited

U.S. PATENT DOCUMENTS

| | | | | |
|---|---|---|---|---|
| 6,476,696 | B1 | 11/2002 | Mack | |
| 6,518,864 | B1 * | 2/2003 | Ito | H01P 3/003 333/238 |
| 7,142,165 | B2 * | 11/2006 | Sanchez | H01P 3/123 343/771 |
| 7,573,430 | B2 * | 8/2009 | Bergmark | H01P 1/208 29/600 |
| 8,179,045 | B2 * | 5/2012 | Goren | H01P 3/123 315/3.5 |
| 10,158,158 | B2 * | 12/2018 | Kirino | H01P 1/211 |
| 10,263,310 | B2 * | 4/2019 | Kildal | H01Q 13/106 |
| 10,498,000 | B2 * | 12/2019 | Hadavy | B21K 23/00 |
| 2005/0128028 | A1 | 6/2005 | Sanchez et al. | |
| 2005/0184835 | A1 | 8/2005 | Mack | |
| 2011/0187614 | A1 * | 8/2011 | Kirino | G01S 7/032 343/713 |

FOREIGN PATENT DOCUMENTS

| | | | |
|---|---|---|---|
| JP | S59185402 | A | 10/1984 |
| JP | H06-334408 | A | 12/1994 |
| JP | 2003304106 | A | 10/2003 |
| JP | 2005020152 | A | 1/2005 |
| WO | 2010003808 | A2 | 1/2010 |
| WO | 2010050122 | A1 | 3/2012 |
| WO | 2014/090290 | A1 | 6/2014 |
| WO | 2014090290 | A | 6/2014 |
| WO | 2015/172948 | A2 | 11/2015 |
| WO | 2017/050817 | A1 | 3/2017 |

OTHER PUBLICATIONS

International Written Opinion mailed Feb. 2, 2017 for International Application No. PCT/EP2016/072409 entitled "Waveguides and Transmission Lines in Gaps Between Parallel Conducting Surfaces".

Brazález, et al., "Improved Microstrip Filters Using PMC Packaging by Lid of Nails", IEEE Transactions on Components, Packaging and Manufacturing Technology, vol. 2, No. 7, Jul. 2012.

Hirokawa et al., "Efficiency of 76-GHz post-wall waveguide-fed parallel-plate slot arrays," IEEE Trans. Antenna Propag., vol. 48, No. 11, pp. 1742-1745, Nov. 2000.

International Preliminary Report on Patentability, PCT/EP2016/072409, "Waveguides and Transmission Lines in Gaps Between Parallel Conducting Surfaces", dated Mar. 27, 2018.

Kildal, et al., "Local metamaterial-based waveguides in gaps between parallel metal plates," IEEE Antennas and Wireless Propagation letters, vol. 8, pp. 84-87, 2009.

Kildal, et al., "Design and experimental verification of ridge gap waveguides in bed of nails for parallel plate mode suppression," IET Microwaves, Antennas & Propagation, vol. 5, iss.3, pp. 262-270, Mar. 2011.

Kildal, "Three metamaterial-based gap waveguides between parallel metal plates for mm/submm waves", 3rd European Conference on Antennas and Propagation, Berlin, Mar. 2009.

Pucci, et al., "New Microstrip Gap Waveguide on Mushroom-Type EBG for Packaging of Microwave Components", IEEE Microwave and Wireless Components Letters, vol. 22, No. 3, pp. 129-131, Mar. 2012.

Pucci, et al, "Planar Dual-Mode Horn Array with Corporate-Feed Network in Inverted Microstrip Gap Waveguide", accepted for publication in IEEE Transactions on Antennas and Propagation, Mar. 2014.

Pucci, et al., "New low loss inverted microstrip line using gap waveguide technology for slot antenna applications", 6th European Conference on Antennas and Propagation EuCAP 2011, Rome, Apr. 11-15, 2011.

Pucci, et al., "Design of a four-element horn antenna array fed by inverted microstrip gap waveguide", 2013 IEEE International Symposium on Antennas and Propagation (IEEE AP-S 2013), Orlando, USA, Jul. 7-12, 2013.

Rajo-Iglesias, et al., "Numerical studies of bandwidth of parallel plate cut-off realized by bed of nails, corrugations and mushroom-type EBG for use in gap waveguides," IET Microwaves, Antennas & Propagation, vol. 5, No. 3, pp. 282-289, Mar. 2011.

Razavi, et al., "Design of 60GHz Planar Array Antennas Using PCB-based Microstrip-Ridge Gap Waveguide and SIW", 8th European Conference on Antennas and Propagation EuCAP 2014, The Hague, The Netherlands, Apr. 6-11, 2014.

Valero-Nogueira, et al., "Gap waveguides using a suspended strip on a bed of nails," IEEE Antennas and Wireless Propag. Letters, vol. 10, pp. 1006-1009, 2011.

Zaman, et. al., "Narrow-band microwave filter using high Q groove gap waveguide resonators without sidewalls", IEEE Transactions on Components, Packaging and Manufacturing Technology, vol. 2, No. 11, pp. 1882-1889, Nov. 2012.

Zaman, et al., "Gap Waveguide PMC Packaging for Improved Isolation of Circuit Components in High Frequency Microwave Modules", IEEE Transactions on Components, Packaging and Manufacturing Technology, vol. 4, Issue 1, p. 16-25, 2014.

* cited by examiner

WAVEGUIDES AND TRANSMISSION LINES IN GAPS BETWEEN PARALLEL CONDUCTING SURFACES

This application is the U.S. National Stage of International Application No. PCT/EP2016/072409, filed Sep. 21, 2016, which designates the U.S., published in English, and claims priority under 35 U.S.C. § 119 or 365(c) to European Application No. 15186666.2, filed Sep. 24, 2015. The entire teachings of the above applications are incorporated herein by reference.

FIELD OF THE INVENTION

The present invention relates to a new type of microwave devices, and in particular technology used to design, integrate and package the radio frequency (RF) part of an antenna system, for use in communication, radar or sensor applications, and e.g. components such as waveguide couplers, diplexers, filters, antennas, integrated circuit packages and the like.

The invention relates mainly to frequencies above 30 GHz, i.e. the millimetre wave region, and even above 300 GHz, i.e. submillimeter waves, but the invention may also be advantageous at lower frequencies than 30 GHz.

BACKGROUND

Electronic circuits are today used in almost all products, and in particular in products related to transfer of information. Such transfer of information can be done along wires and cables at low frequencies (e.g. wire-bound telephony), or wireless through air at higher frequencies using radio waves both for reception of e.g. broadcasted audio and TV, and for two-way communication such as in mobile telephony. In the latter high frequency cases both high and low frequency transmission lines and circuits are used to realize the needed hardware. The high frequency components are used to transmit and receive the radio waves, whereas the low frequency circuits are used for modulating the sound or video information on the radio waves, and for the corresponding demodulation. Thus, both low and high frequency circuits are needed. The present invention relates to a new technology for realizing high frequency components such as transmitter circuits, receiver circuits, filters, matching networks, power dividers and combiners, couplers, antennas and so on.

The first radio transmissions took place at rather low frequency below 100 MHz, whereas nowadays the radio spectrum (also called electromagnetic spectrum) is used commercially up to 40 GHz and above. The reason for the interest in exploring higher frequencies is the large bandwidths available. When wireless communication is spread to more and more users and made available for more and more services, new frequency bands must be allocated to give room for all the traffic. The main requirement is for data communication, i.e. transfer of large amounts of data in as short time as possible.

There exist already transmission lines for light waves in the form of optical fibers that can be buried down and represents an alternative to radio waves when large bandwidth is needed. However, such optical fibers also require electronic circuits connected at either end. There may even be needed electronic circuits for bandwidths above 40 GHz to enable use of the enormous available bandwidths of the optical transmission lines. The present invention relates to gap waveguide technology (see below), which has been found to have excellent properties, such as low losses, and which is very suitable for mass production.

Further, there is a need for technologies for fast wireless communication in particular at 60 GHz and above, involving high gain antennas, intended for consumer market, so low-cost manufacturability is a must. The consumer market prefers flat antennas, and these can only be realized as flat planar arrays, and the wide bandwidth of these systems require corporate distribution network. This is a completely branched network of lines and power dividers that feed each element of the array with the same phase and amplitude to achieve maximum gain.

A common type of flat antennas is based on a microstrip antenna technology realized on printed circuits boards (PCB). The PCB technology is well suited for mass production of such compact lightweight corporate-fed antenna arrays, in particular because the components of the corporate distribution network can be miniaturized to fit on one PCB layer together with the microstrip antenna elements. However, such microstrip networks suffer from large losses in both dielectric and conductive parts. The dielectric losses do not depend on the miniaturization, but the conductive losses are very high due to the miniaturization. Unfortunately, the microstrip lines can only be made wider by increasing substrate thickness, and then the microstrip network starts to radiate, and surface waves starts to propagate, both destroying performance severely.

There is one known PCB-based technology that have low conductive losses and no problems with surface waves and radiation. This is referred to by either of the two names substrate-integrated waveguide (SIW), or post-wall waveguide as in [1]. We will herein use the term SIW only. However, the SIW technology still has significant dielectric losses, and low loss dielectric materials are very expensive and soft, and therefore not suitable for low-cost mass production. Therefore, there is a need for better technologies.

Thus, there is a need for a flat antenna system for high frequencies, such as at or above 60 GHz, and with reduced dielectric losses and problems with radiation and surface waves. In particular, there is a need for a PCB based technology for realizing corporate distribution networks at 60 GHz or above that do not suffer from dielectric losses and problems with radiation and surface waves.

The gap waveguide technology is based on Prof Kildal's invention from 2008 & 2009 [2], also described in the introductory paper [3] and validated experimentally in [4]. This patent application as well as the paper [5] describes several types of gap waveguides that can replace microstrip technology, coplanar waveguides, and normal rectangular waveguides in high frequency circuits and antennas.

The gap waveguides are formed between parallel metal plates. The wave propagation is controlled by means of a texture in one or both of the plates. Waves between the parallel plates are prohibited from propagating in directions where the texture is periodic or quasi-periodic (being characterized by a stopband), and it is enhanced in directions where the texture is smooth like along grooves, ridges and metal strips. These grooves, ridges and metal strips form gap waveguides of three different types: groove, ridge and microstrip gap waveguides [6], as described also in the original patent application [2].

The texture can be a periodic or quasi-periodic collection of metal posts or pins on a flat metal surface, or of metal patches on a substrate with metalized via-holes connecting them to the ground plane, as proposed in [7] and also described in the original patent application [2]. The patches with via-holes are commonly referred to as mushrooms.

A suspended (also called inverted) microstrip gap waveguide was presented in [8] and is also inherent in the descriptions in [6] and [7]. This consists of a metal strip that is etched on and suspended by a PCB substrate resting on top of a surface with a regular texture of metal pins. This substrate has no ground plane. The propagating quasi-TEM wave-mode is formed between the metal strip and the upper smooth metal plate, thereby forming a suspended microstrip gap waveguide.

This waveguide can have low dielectric and conductive losses, but it is not compatible with normal PCB technology. The textured pin surface could be realized by mushrooms on a PCB, but this then becomes one of two PCB layers to realize the microstrip network, whereby it would be much more costly to produce than gap waveguides realized only using one PCB layer. Also, there are many problems with this technology: It is difficult to find a good wideband way of connecting transmission lines to it from underneath.

The microstrip gap waveguide with a stopband-texture made of mushrooms were in [9] realized on a single PCB. This PCB-type gap waveguide is called a microstrip-ridge gap waveguide, because the metal strip must have via-holes in the same way as the mushrooms.

A quasi-planar inverted microstrip gap waveguide antenna is described in [10]-[12]. It is expensive both to manufacture the periodic pin array under the microstrip feed network on the substrate located directly upon the pin surface, and the radiating elements which in this case were compact horn antennas.

A small planar array of 4×4 slots were presented in [13]. The antenna was realized as two PCBs, an upper one with the radiating slots realized as an array of 2×2 subarrays, each consisting of 2×2 slots that are backed by an SIW cavity. Each of the 4 SIW cavities was excited by a coupling slot fed by a microstrip-ridge gap waveguide in the surface of a lower PCB located with an air gap below the upper radiating PCB. It was very expensive to realize the PCBs with sufficient tolerances, and in particular to keep the air gap with constant height. The microstrip-ridge gap waveguide also requires an enormous amount of thin metalized via holes that are very expensive to manufacture. In particular, the drilling is expensive.

There is therefore a need for new microwave devices, and in particular waveguide and RF packaging technology, that have good performance and in addition is cost-efficient to produce.

SUMMARY OF THE INVENTION

It is therefore an object of the present invention to alleviate the above-discussed problems, and specifically to provide a new microwave device, such as a waveguide or RF part, and RF packaging technology, which has good performance and which is cost-efficient to produce, in particular for use above 30 GHz, and e.g. for use in an antenna system for use in communication, radar or sensor applications.

This object is achieved with a microwave device in accordance with the appended claims.

According to a first aspect of the invention there is provided a microwave device, such as a waveguide, transmission line, waveguide circuit, transmission line circuit or radio frequency (RF) part of an antenna system, the microwave device comprising two conducting layers arranged with a gap there between, and protruding elements arranged in a periodically or quasi-periodically pattern and fixedly connected to at least one of said conducting layers, thereby forming a texture to stop wave propagation in a frequency band of operation in other directions than along intended waveguiding paths, wherein each of said conducting layers comprises a thereto fixedly connected set of complementary protruding elements, said sets in combination forming said texture, the sets of complementary protruding elements being either each formed in said pattern and arranged in alignment and overlying each other, the complementary protruding elements of each set forming part of the full length of each protruding element of the pattern, or the sets of complementary protruding elements being arranged in an offset complementary arrangement, the protruding elements of one set thereby being arranged in between the protruding elements of the other set.

Even though gap waveguides have been found to have exceptionally good properties, in particular at high frequencies, the task of producing such microwave devices cost-efficiently has remained problematic. Formation of posts/pins protruding from a surface is relatively uncomplicated when few and large posts/pins are needed, but for high frequencies, hundreds or thousands of very small but relatively high posts/pins are needed, arranged very close to each other. Such structures are difficult to produce by conventional manufacturing. In particular it has been realized that the higher the posts/pins become and the more densely they are arranged, the higher the production costs becomes, and the increase is quite dramatic because the tolerance requirements becomes stricter the more dense they are.

An efficient remedy to this problem has now been found. In particular it has been found that the texture used to stop wave propagation may be distributed between the two conducting surfaces, and still work just as well as previously known microwave devices using gap waveguide technology. Hereby, the protruding elements, e.g. formed as posts or pins, can be made half as high as conventional posts/pins, or with much lower density and increased separation distances between the protruding elements. Such textures having protruding elements of strongly reduced height or density can be produced much more cost-efficiently, thereby greatly lowering the overall production costs for the microwave device.

The protruding elements are preferably arranged in a periodic or quasi-periodic pattern in the textured surface, and are designed to stop waves from propagating between the two metal surfaces, in other directions than along the waveguiding structure. The frequency band of this forbidden propagation is called the stopband, and this defines the maximum available operational bandwidth of the gap waveguide.

In the context of the present application, the term "microwave device" is used to denominate any type of device and structure capable of transmitting, transferring, guiding and controlling the propagation of electromagnetic waves, particularly at high frequencies where the dimensions of the device or its mechanical details are of the same order of magnitude as the wavelength, such as waveguides, transmission lines, waveguide circuits or transmission line circuits. In the following, the present invention will be discussed in relation to various embodiments, such as waveguides, transmission lines, waveguide circuits or transmission line circuits. However, it is to be appreciated by someone skilled in the art that specific advantageous features and advantages discussed in relation to any of these embodiments are also applicable to the other embodiments.

By RF part is in the context of the present application meant a part of an antenna system used in the radio frequency transmitting and/or receiving sections of the antenna system, sections which are commonly referred to as the front end or RF front end of the antenna system. The RF part may be a separate part/device connected to other components of the antenna system, or may form an integrated part of the antenna system or other parts of the antenna system. The waveguide and RF packaging technology of the present invention are in particular suitable for realizing a wideband and efficient flat planar array antenna. However, it may also be used for other parts of the antenna system, such as waveguides, filters, integrated circuit packaging and the like, and in particular for integration and RF packaging of such parts into a complete RF front-end or antenna system. In particular, the present invention is suitable for realization of RF parts being or comprising gap waveguides.

In previously described gap waveguides, the waves propagate mainly in the air gap between two conducting layers, where at least one is provided with a surface texture, here being formed by the protruding elements. The gap is thereby provided between the protruding elements of one layer and the other conducting layer. Such gap waveguides have very advantageous properties and performance, especially at high frequencies. However, a drawback with the known gap waveguides is that they are relatively cumbersome and costly to produce. In particular, it is complicated to provide the second layer suspended at a more or less constant height over the protruding elements, and at the same time avoid contact between the second layer and the protruding elements.

However, it has now surprisingly been found that the same advantageous waveguide properties and performance as in previous gap waveguides can be achieved even when some of the protruding elements—but not necessarily all of them—are in contact also with the other conducting layer, or where gaps are provided on either side in distributed fashion, or in between aligned parts of the protruding elements. It has been found that a mechanical connection between the other conducting layer and some arbitrary selection or all of the protruding elements does not affect the advantageous properties and electromagnetic performance of the microwave device. It has also been found that the properties are not affected even if there is an occasional electrical contact between some of the protruding elements and the conducting layer, or even if there is electrical contact between all the protruding elements and the other conducting layer. Thus, the provision of some contact between the protruding elements and the overlying conducting layer or overlying protruding elements, such as only mechanical contact but no electric contact or bad electric contact, or even good electric contact, does not affect the electromagnetic performance of the device. This allows the parts to rest on each other, which greatly facilitates manufacturing, and also makes the microwave device more robust and easier to adjust and repair afterwards.

Thus, the microwave device can be manufactured by arranging each protruding element in two separate parts, the parts being arranged on different layers, and arranged to be aligned with each other. The parts are preferably arranged in contact with each other, but a small gap there between may also be provided. Alternatively, protruding elements may be arranged as a first set of protruding elements on one of the layers, and a second set of protruding elements on the other layer, the sets being arranged to be interleaved between each other.

Thus, according to one line of embodiments, the sets of complementary protruding elements are formed in said pattern and arranged in alignment with each other. In this line of embodiments, the protruding elements of both sets are all preferably of the same length, said length being half the length of the full-length protruding elements of the texture. This maximizes the cost-savings. However, other subdivisions of the full length are also feasible, so that the protruding elements on one side are higher than the protruding elements on the other side. Further, even though it is generally preferred that the protruding elements on each conducting surface all are of the same height, it is also feasible to use protruding elements of two or more different heights, and provide a complementary height difference in the protruding elements of the other conducting surface. Shorter pins are much easier and much more cost-efficient to produce, e.g. by use of milling, die forming and the like.

According to another line of embodiments, the sets of complementary protruding elements are arranged in an offset complementary arrangement. For example, the protruding elements of each set may be arranged in rows, wherein the protruding elements in each row are arranged in a staggered disposition in relation to adjacent rows, the protruding elements of the sets thereby being interleaved between each other both within each row. Thus, the distance between each protruding element in each set to its nearest neighboring protruding elements, both within the same row as in the adjacent rows, is hereby increased. However, many other distributions forming complementary patterns in the two sets are also feasible. According to another example, the sets of complementary protruding elements are arranged in an offset complementary arrangement, the protruding elements of each set being arranged in rows, wherein the distance between the rows is double the distance between neighboring protruding elements within the rows, the rows of the sets thereby being interleaved between each other. Thus, here the distance between each protruding element in each set is greatly increased in one direction, viz. the direction transversal to the rows, but remains the same in one direction, viz. the direction along the rows. Increased separation between the protruding elements dramatically lowers the manufacturing costs.

Preferably, all protruding elements of each of said conducting layers are connected electrically to each other at their bases at least via said conductive layer on which they are fixedly connected.

At least one of said conductive layers is further preferably provided with a waveguiding path, preferably for a single-mode wave. The waveguiding path is preferably one of a conducting ridge and a groove with conducting walls. In one such embodiment, the protruding elements in at least one of the conducting layers are preferably arranged to at least partly surround a cavity between said conducting layers, said cavity thereby forming said groove functioning as a waveguide.

The waveguiding path may be provided in the form of a conducting element arranged on one of the conducting layers, but not in electrical contact with the other of said two conducting layers. Thus, a gap is provided between the other conducting layer, whereas the surrounding protruding elements may be in mechanical and possibly also electrical contact with this layer. Here, the gap between a conducting element in the form of a ridge and the overlying conducting layer is preferably in the range of 1-50% of the height of the protruding elements and preferably in the range of 5-25%, and most preferably in the range of 10-20%. The heights of the protruding elements are typically smaller than quarter wavelength.

The protruding elements are preferably arranged in at least two parallel rows on both sides along each waveguiding path. However, occasionally, such as along straight passages and the like, and in some particular applications, a single row may suffice. Further, more than two parallel rows may also advantageously be used in many embodiments, such as three, four or more parallel rows.

In one embodiment, the RF part is a waveguide, and wherein the protruding elements are further in contact with, and preferably fixedly connected to, also the other conducting layer, and wherein the protruding elements are arranged to at least partly surround a cavity between said conducting layers, said cavity thereby functioning as a waveguide. Hereby, the protruding elements may be arranged to at least partly provide the walls of a tunnel or a cavity connecting said conducting layers across the gap between them, said tunnel thereby functioning as a waveguide or a waveguide cavity. Thus, in this embodiment, a smooth upper plate (conducting layer) can also rest on the grid array formed by the protruding elements of the other conducting layer, or on some part of it, and the protruding elements/pins that provide the support can e.g. be soldered to the upper smooth metal plate (conducting layer) by baking the construction in an oven. Thereby, it is possible to form post-wall waveguides as described in [1], said documents hereby being incorporated in its entirety by reference, but without any substrate inside the waveguide. Thus, SIW waveguides are provided without the substrate so to say. Such rectangular waveguide technology is advantageous compared to conventional SIW because it reduces the dielectric losses, since there is no substrate inside the waveguide, and the rectangular waveguides can also be produced more cost-effectively, and since the use of expensive lowloss substrate material may now be reduced or even omitted.

The microwave device is preferably a radio frequency (RF) part of an antenna system, e.g. for use in communication, radar or sensor applications.

The protruding elements preferably have maximum cross-sectional dimensions of less than half a wavelength in air at the operating frequency. It is further preferred that the protruding elements in the texture stopping wave propagation are spaced apart by a spacing being smaller than half a wavelength in air at the operating frequency. This means that the separation between any pair of adjacent protruding elements in the texture is smaller than half a wavelength.

The distance between adjacent protruding elements in the pattern of periodically or quasi-periodically arranged protruding elements is preferably in the range of 0.05-2.0 mm, and preferably in the range 0.1-1.0 mm, all dependent on which frequency band they are designed for. The period of adjacent protruding elements is preferably smaller than a half wavelength. In case a staggered, offset arrangement is used, the period may be doubled within each set that is combined to form the pattern, either in between adjacent protruding elements within each row, or between adjacent rows.

The protruding elements, preferably in the form of posts or pins, may have any cross-sectional shape, but preferably have a square, rectangular or circular cross-sectional shape. Further, the protruding elements preferably have maximum cross-sectional dimensions of smaller than half a wavelength in air at the operating frequency. Preferably, the maximum dimension is much smaller than this. The maximum cross-sectional/width dimension is the diameter in case of a circular cross-section, or diagonal in case of a square or rectangular cross-section.

Further, each of the protruding elements preferably has a maximum width dimension in the range 0.05-1.0 mm, and preferably in the range 0.1-0.5 mm, all dependent on the frequency band they are designed for, and naturally always smaller than the period.

The full length of each protruding element of the pattern, i.e. the total protruding height of the protruding elements, is equal to the height of the individual protruding elements when arranged in an offset disposition, or the combined height of the overlying protruding elements, when arranged in an aligned disposition. The full/total protruding height is preferably greater than the width and thickness of the protruding elements, and preferably greater than double the width and thickness.

At least some, and preferably all, of the protruding elements may further be in direct or indirect mechanical contact with said other conducting layer.

The protruding elements preferably have essentially identical heights, the maximum height difference between any pair of protruding are due to mechanical tolerances. This depends on manufacturing method and frequency of operation, and cause some protruding elements to be in mechanical and even electrical contact with the overlaying conducting layer, others not. The tolerances must be good enough to ensure that the possibly occurring gap between any protruding element and the overlying conducting layer is kept to a minimum.

The two conducting layers may be connected together for rigidity by a mechanical structure at some distance outside the region with guided waves, where the mechanical structure may be integrally and preferably monolithically formed on at least one of the conducting materials defining one of the conducting layers.

At least part of the two conducting layers may be mostly planar except for the fine structure provided by the ridges, grooves and texture.

The sets of protruding elements are preferably monolithically formed on said conducting layers, by e.g. milling or die forming/coining.

The waveguide elements of the microwave device are preferably made of metal.

At least one of the conducting layers may further be provided with at least one opening, preferably in the form of rectangular slot(s), said opening(s) allowing radiation to be transmitted to and/or received from said microwave device.

Further, the microwave device may comprise at least one integrated circuit module, such as a monolithic microwave integrated circuit module, arranged between said conducting layers, at least some of the protruding elements thereby functioning as a means of removing resonances within the package for said integrated circuit module(s). The integrated circuit module(s) is preferably arranged on one of said conducting layer, and wherein protruding elements overlying the integrated circuit(s) are shorter than protruding elements not overlying said integrated circuit(s). In a preferred such embodiment, the at least one integrated circuit is a monolithic microwave integrated circuit (MMIC).

The microwave device is preferably adapted to form waveguides for frequencies exceeding 20 GHz, and preferably exceeding 30 GHz, and most preferably exceeding 60 GHz.

The microwave device may further form a flat array antenna comprising a corporate distribution network realized by a microwave device as discussed above. Preferably, the corporate distribution network forms a branched tree with power dividers and waveguide lines between them. This may e.g. be realized as gap waveguides as discussed in the foregoing. The distribution network is preferably fully or partly corporate containing power dividers and transmission lines, realized fully or partly as a gap waveguide.

The antenna may also be an assembly of a plurality of sub-assemblies, whereby the total radiating surface of the antenna is formed by the combination of the radiating sub-assembly surfaces of the sub-assemblies. Each such sub-assembly surface may be provided with an array of radiating slot openings, as discussed in the foregoing. The sub-assembly surfaces may e.g. be arranged in a side-by-side arrangement, to form a square or rectangular radiating surface of the assembly. Preferably, one or more elongated slots working as corrugations may further be arranged between the sub-arrays, i.e. between the sub-assembly surfaces, in the E-plane.

The antenna system may further comprise horn shaped elements connected to the openings in the metal surface of the gap waveguide. Such slots are coupling slots that make a coupling to an array of horn-shaped elements which are preferably located side-by-side in an array in the upper metal plate/conducting layer. The diameter of each horn element is preferably larger than one wavelength. An example of such horn array is per se described in [10], said document hereby being incorporated in its entirety by reference.

When several slots are used as radiating elements in the upper plate, the spacing between the slots is preferably smaller than one wavelength in air at the operational frequency.

The slots in the upper plate may also have a spacing larger than one wavelength. Then, the slots are coupling slots, which makes a coupling from the ends of a distribution network arranged in the textured surface to a continuation of this distribution network in a layer above it, that divides the power equally into an array of additional slots that together form a radiating array of subarray of slots, wherein the spacing between each slot of each subarray preferably is smaller than one wavelength. Hereby, the distribution network may be arranged in several layers, thereby obtaining a very compact assembly. For example, first and second gap waveguide layers may be provided, in the aforementioned way, separated by a conductive layer comprising the coupling slots, each of which make a coupling from each ends of the distribution network on the textured surface to a continuation of this distribution network that divides the power equally into a small array of slots formed in a conducting layer arranged at the upper side of the second gap waveguide, that together form a radiating subarray of the whole array antenna. The spacing between each slot of the subarray is preferably smaller than one wavelength. Alternatively, only one of said waveguide layers may be a gap waveguide layer, whereby the other layer may be arranged by other waveguide technology.

The distribution network is at the feed point preferably connected to the rest of the RF front-end containing duplexer filters to separate the transmitting and receiving frequency bands, and thereafter transmitting and receiving amplifiers and other electronics. The latter are also referred to as converter modules for transmitting and receiving. These parts may be located beside the antenna array on the same surface as the texture forming the distribution network, or below it. A transition is preferably provided from the distribution network to the duplexer filter, and this may be realized with a hole in the ground plane of the lower conducting layer and forming a rectangular waveguide interface on the backside of it. Such rectangular waveguide interface can also be used for measurement purposes.

Like in previously known gap waveguide, the waveguides provided by the present invention guides waves that propagate mainly in the air gap between the conducting layers, and along paths defined by the protruding elements. The cavity formed between the conducting layers and not filled by the protruding elements can also be filled fully or partly by dielectric material. The periodic or quasi-periodic protruding elements in the textured surface are preferably provided on both sides of the waveguiding paths, and are designed to stop waves from propagating between the two metal surfaces, in other directions than along the waveguiding structure. The frequency band of this forbidden propagation is called the stopband, and this defines the maximum available operational bandwidth of the gap waveguide.

The protruding elements may be formed in various ways, some of which are per se previously known. For example, the protruding elements may be formed by drilling, milling, etching and the like. It is further possible to form the protruding elements by die forming, coining or multilayer die forming.

For die forming, a die is provided with a plurality of recessions forming the negative of the protruding elements. A formable piece of material is then placed on the die, and pressure is applied to the formable piece of material, thereby compressing the formable piece of material to conform with the recessions of the die. The die may be provided in one layer, comprising the recessions. However, the die may alternatively comprise two or more layers, at least some of which are provided with through-holes, wherein the recessions are formed by stacking the layers on top of each other. Coining or die forming using such multi-layered dies are here referred to as multilayer die forming. In case three, four, five or even more layers are used, each layer, apart from possibly the bottom layer, has through-holes which appear as recessions when the layers are put on top of each other, and at least some of the throughholes of the different layers being in communication with each other. The recessions in the die can be formed by means of drilling, milling, etching or the like. The forming of the die layer is relatively simple, and the same die layer may be reused many times. Further, the die layer can easily be exchanged, enabling reuse of the rest of the die and production equipment for production of other RF-parts. This makes the production flexible to design changes and the like. The production process is also very controllable, and the produced RF parts have excellent tolerances. Further, the production equipment is relatively inexpensive, and at the same time provides high productivity. Thus, the production method and apparatus is suitable both for low volume prototype production, production of small series of customized parts, and for mass production of large series.

The die may further comprise at least one die layer comprising through-holes forming said recessions. In a preferred embodiment, the die comprises at least two sandwiched die layers comprising through-holes. Hereby, the sandwiched layers may be arranged to provide various heights and/or shapes of the protruding elements. For example, such sandwiched die layers may be used for cost-efficient realization of protruding elements having varying heights, such as areas of protruding elements of different heights, or realization of protruding element having varying width dimensions, such as being conical, having a stepwise decreasing width, or the like. It may also be used to form ridges, stepped transitions, etc. Preferably, the at least one die layer is arranged within the collar.

These and other features and advantages of the present invention will in the following be further clarified with reference to the embodiments described hereinafter. Notably, the invention is in the foregoing described in terms of a terminology implying a transmitting antenna, but naturally the same antenna may also be used for receiving, or both receiving and transmitting electromagnetic waves. The performance of the part of the antenna system that only contains passive components is the same for both transmission and reception, as a result of reciprocity. Thus, any terms used to describe the antenna above should be construed broadly, allowing electromagnetic radiation to be transferred in any or both directions. E.g., the term distribution network should not be construed solely for use in a transmitting antenna, but may also function as a combination network for use in a receiving antenna.

BRIEF DESCRIPTION OF THE DRAWINGS

For exemplifying purposes, the invention will be described in closer detail in the following with reference to embodiments thereof illustrated in the attached drawings, wherein:

FIG. 3 is a schematic illustration of an array antenna in accordance with another embodiment of the present invention, where

FIG. 9 is an illustration of a gap waveguide packaged MMIC amplifier chains, in accordance with a further embodiment of the present invention, and where

DETAILED DESCRIPTION

In the following detailed description, preferred embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well-known constructions or functions are not described in detail, so as not to obscure the present invention.

In the following, some exemplary microwave devices in accordance with the present invention will first be generally discussed. The protruding elements forming a stop band are here formed in the novel way discussed in the last sections.

Figure 1:
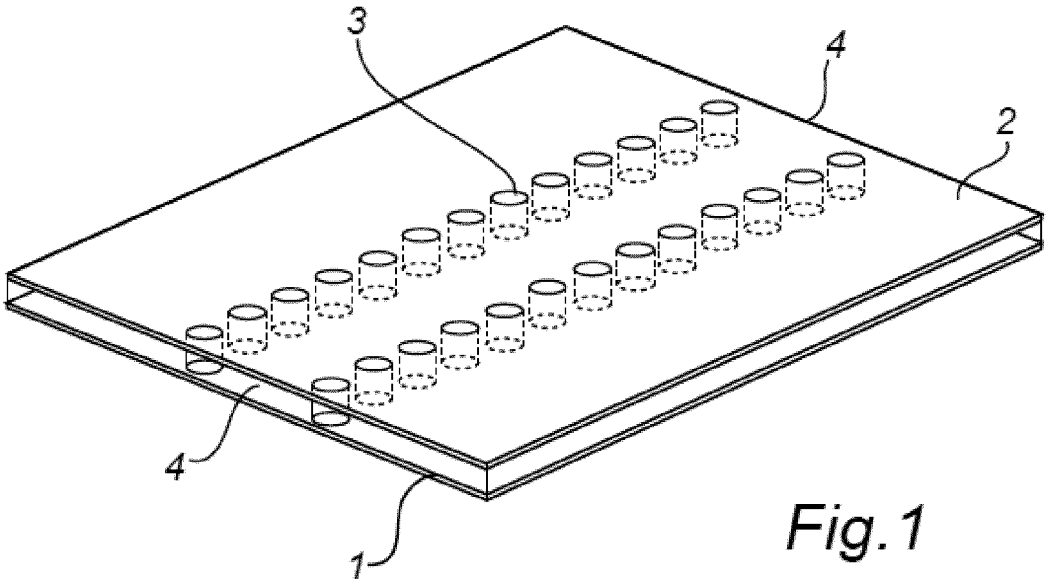
FIG. 1 is a perspective side view showing a gap waveguide in accordance with one embodiment of the present invention.

In a first embodiment, as illustrated in FIG. 1, an example of a rectangular waveguide is illustrated. The waveguide comprises a first conducting layer 1, and a second conducting layer 2 (here made semi-transparent, for increased visibility). The conducting layers are arranged at a constant distance h from each other, thereby forming a gap there between.

This waveguide resembles a conventional SIW with metallized via holes in a PCB with metal layer (ground) on both sides, upper (top) and lower (bottom) ground plane. However, here there is no dielectric substrate between the conducting layers, and the metalized via holes are replaced with a plurality of protruding elements 3 extending from one or both of the conducting layers. The protruding elements 3 are made of conducting material, such as metal. They can also be made of metallized plastics or ceramics.

Further, the first and second conductive layers may be attached to each other by means of a rim, extending around the periphery of one of the conducting layers. The rim is not illustrated, for increased visibility.

Similar to a SIW waveguide, a waveguide is here formed between the conducting elements, here extending between the first and second ports 4.

In this example, a very simple, straight waveguide is illustrated. However, more complicated paths may be realized in the same way, including curves, branches, etc.

The waveguide path may, as is per se known in the art, be formed as a conducting ridge, a conducing grove, or as a microstrip.

The protruding elements may have circular cross-section geometry (as shown in FIG. 1) or rectangular or square cross-sectional geometry. Other cross-sectional geometries are also feasible.

Figure 2:
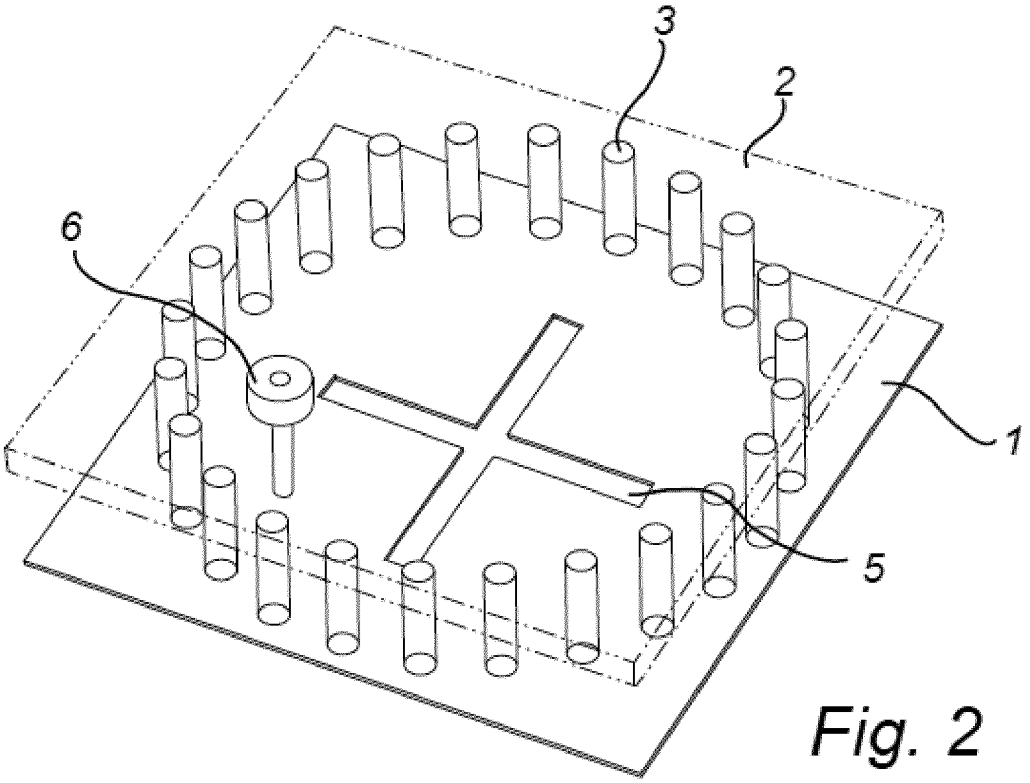
FIG. 2 is a perspective side view showing a circular cavity of a gap waveguide in accordance with another embodiment of the present invention.

FIG. 2 illustrates a circular cavity of a gap waveguide. This is realized in a similar way as in the above-discussed straight waveguide of FIG. 1, and comprises first and second conducting layers 1, 2, arranged with a gap there between, and protruding elements extending between the conducting layers, and connected to these layers. The protruding elements 3 are here arranged along a circular path, enclosing a circular cavity. Further, in this exemplary embodiment, a feeding arrangement 6 and an X-shaped radiating slot opening 5 is provided.

This circular waveguide cavity functions in similar ways as circular SIW cavity.

With reference to FIG. 3, an embodiment of a flat array antenna will now be discussed. This antenna structurally and functionally resembles the antenna discussed in [13], said document hereby being incorporated in its entirety by reference.

Figure 3A:
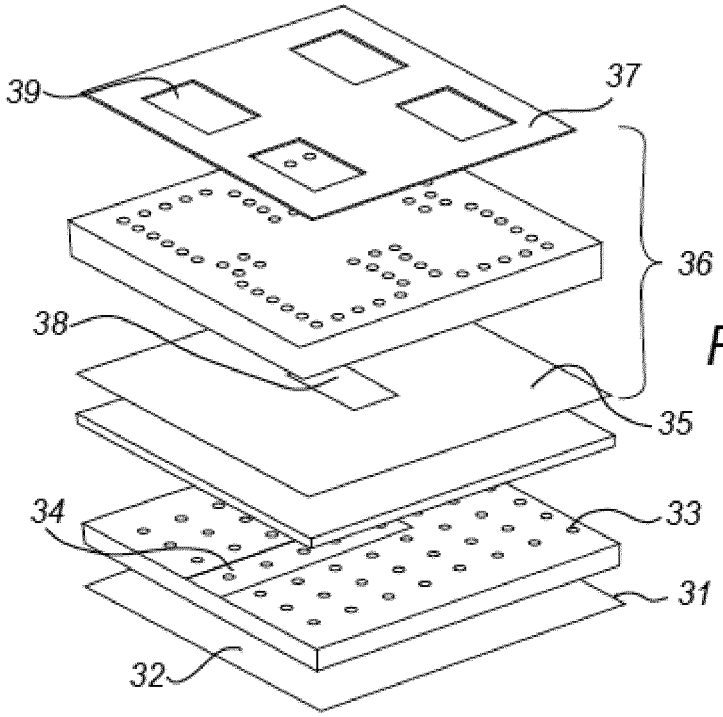
FIG. 3*a* is an exploded view of a subarray/sub-assembly of said antenna.
Figure 3B:
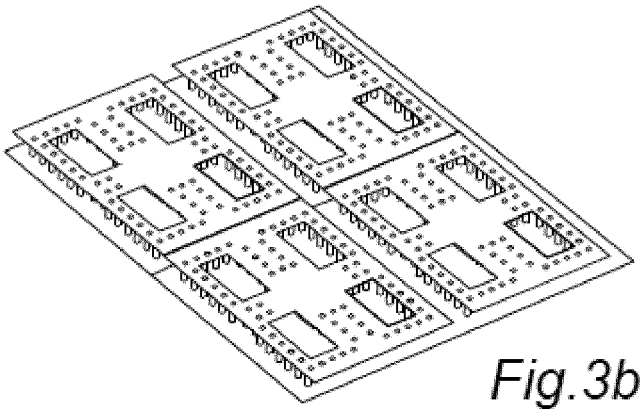
FIG. 3*b* is a perspective view of an antenna comprising four such subarrays/sub-assemblies.

FIG. 3*a* shows the multilayer structure of a sub-assembly in an exploded view. The sub-assembly comprises a lower gap waveguide layer 31 with a first ground plane/conducting layer 32, and a texture formed by protruding elements 33 and a ridge structure 34, together forming a gap waveguide between the first ground plane 32 and a second ground plane/conducting layer 35. The second ground plane 35 is here arranged on a second, upper waveguide layer 36, which also comprises a third, upper ground plane/conducting layer 37. The second waveguide layer may also be formed as a gap waveguide layer. A gap is thus formed between both the first and second ground planes and between the second and third ground planes, respectively, thereby forming two layers of waveguides. The bottom, second ground plane 35 of the upper layer has a coupling slot 38, and the upper one has 4 radiating slots 39, and between the two ground planes there is a gap waveguide cavity. FIG. 3*a* shows only a single subarray forming the unit cell (element) of a large array. FIG. 3*b* shows an array of 4 such subarrays, arranged side-by-side in a rectangular configuration. There may be even larger arrays of such subarrays to form a more directive antenna.

Between the subarrays, there is in one direction provided a separation, thereby forming elongated slots in the upper metal plate. Protruding elements/pins are arranged along both sides of the slots. This forms corrugations between the subarrays in E-plane.

Figure 3C:
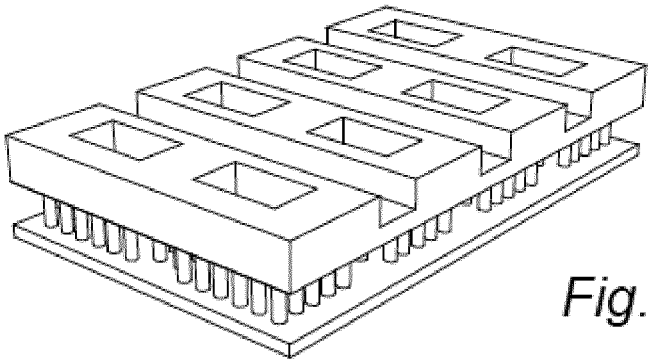
FIG. 3*c* is a perspective view of an alternative way of realizing the antenna of FIG. 3*b;*

In FIG. 3*c*, an alternative embodiment is shown, in which the upper conducting layer, including several sub-arrays, is formed as a continuous metal plate. This metal plate preferably has a thickness sufficient to allow grooves to be formed in it. Hereby, elongate corrugations having similar effects as the slots in FIG. 3*b* can instead be realized as elongate grooves extending between the unit cells.

Either or both of the waveguide layers between the first and second conducting layer and the second and third conducting layer, respectively, may be formed as gap waveguides as discussed in the foregoing, without any substrate between the two metal ground planes, and with protruding elements extending between the two conducting layers. Then, the conventional via holes, as discussed in [13], will instead be metal pins or the like, which are monolithically formed between the two metal plates, within each unit cell of the whole antenna array.

Figure 4:
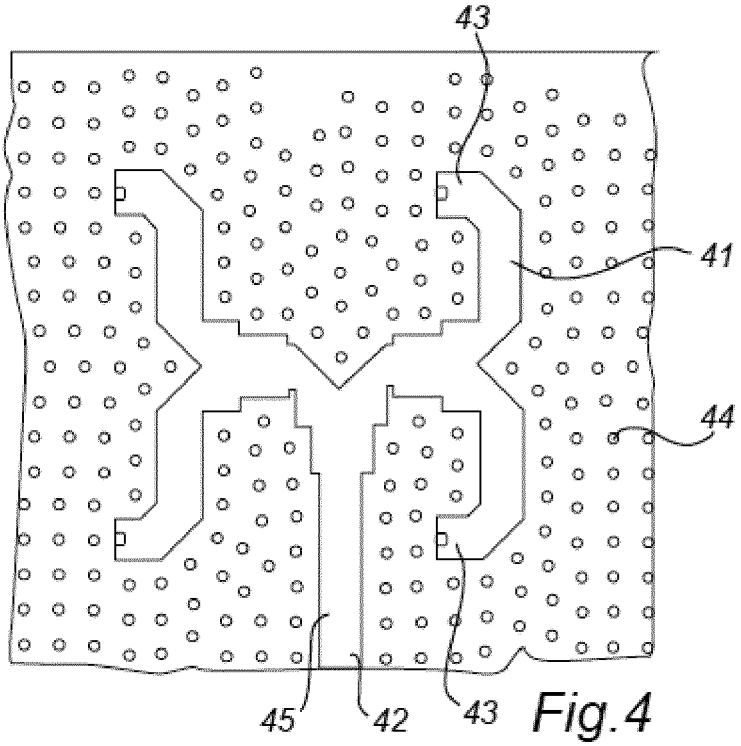
FIG. 4 is a top view of an exemplary distribution network realized in accordance with the present invention, and useable e.g. in the antenna of FIG. 3.

In FIG. 4, a top view of an example of the texture in the lower gap waveguide layer of the antenna in FIG. 3 is illustrated. This shows a distribution network 41 in ridge gap waveguide technology in accordance with [13], for waves in the gap between the two lower conducting layers. The ridge structure 45 forms a branched so-called corporate distribution network from one input port 42 to four output ports 43. The distribution network may be much larger than this with many more output ports to feed a larger array. In contrast to the antenna of [13], the via-holes arranged to provide a stopping texture are here formed as protruding elements 44 monolithically formed in the above-described manner. Hereby, there is no or partly no substrate and the via holes are replaced by the protruding elements/pins. Hereby, the ridge becomes a solid ridge such as shown in the ridge gap waveguides in e.g. [4]. Alternatively, the ridge may be drawn as a thin metal strip, a microstrip, supported by pins.

Figure 5:
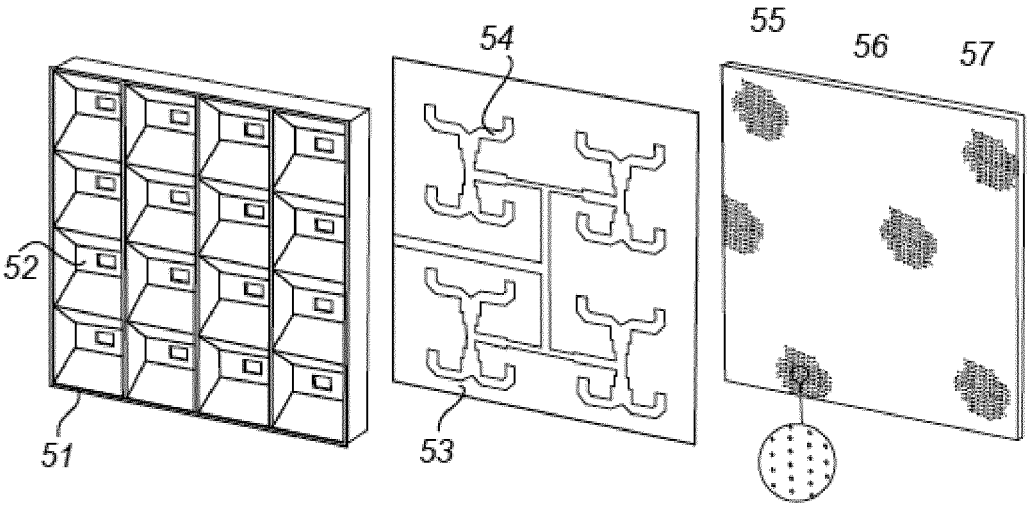
FIG. 5 is a perspective and exploded view of three different layers of an antenna in accordance with another alternative embodiment of the present invention making use of an inverted microstrip gap waveguide.

With reference to FIG. 5, another embodiment of an antenna will now be discussed. This antenna comprises three layers, illustrated separately in an exploded view. The upper layer 51 (left) comprises an array of radiating horn elements 52 formed therein. The middle layer 53 is arranged at a distance from the upper layer 51, so that a gap towards the upper layer is provided. This middle layer 53 comprises a microstrip distribution network 54 arranged on a substrate having no ground plane. The waves propagate in the air gap between the upper and middle layer, and above the microstrip paths. A lower layer 55 (right) is arranged beneath and in contact with the middle layer 53. This lower layer comprises an array of protruding elements 56, such as metal pins, preferably monolithically manufactured, on a conducting layer 57. The conducting layer may be formed as a separate metal layer or as a metal surface of an upper ground plane of a PCB. The protruding elements are integrally connected to the conducting layer in such a way that metal contact between the bases of all protruding elements is ensured. Thus, this antenna functionally and structurally resembles the antenna disclosed in [12], said document hereby being incorporated in its entirety by reference. However, whereas this known antenna was realized by milling to form an inverted microstrip gap waveguide network, the present example comprises protruding elements formed in the way discussed in the following, which entails many advantages.

Figure 6:
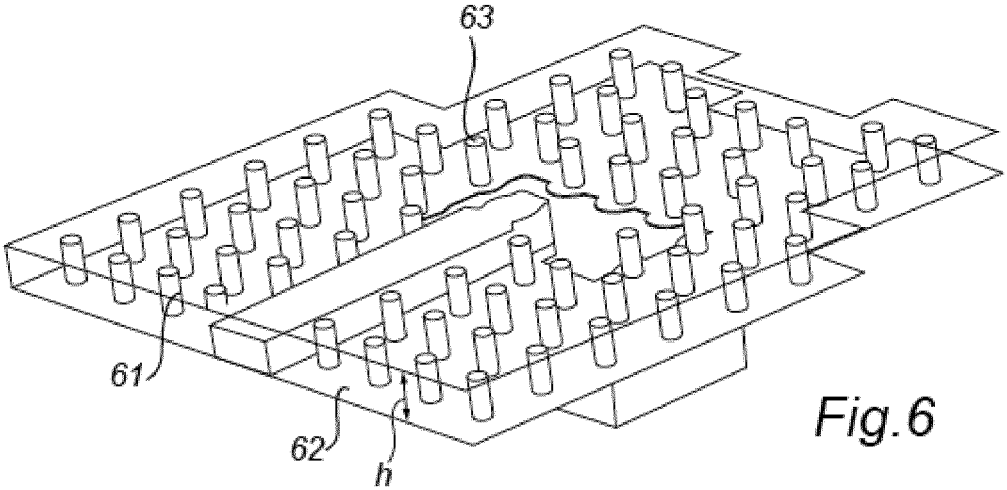
FIG. 6 is a close-up view of an input port of a ridge gap waveguide in accordance with a further embodiment of the present invention.

FIG. 6 provides a close-up view of an input port of a microstrip-ridge gap waveguide on a lower layer showing a transition to a rectangular waveguide through a slot 63 in the ground plane. In this embodiment, there is no dielectric substrate present, and the conventionally used via holes are replaced by protruding elements 61, preferably monolithically connected to the conducting layers in such a way that there is electric contact between all the protruding elements 61. Thus, a microstrip gap waveguide is provided. The upper metal surface is removed for clarity. The microstrip supported by pins, i.e. the microstrip-ridge, may also be replaced by a solid ridge in the same way as discussed above in connection with FIG. 4.

Figure 7:
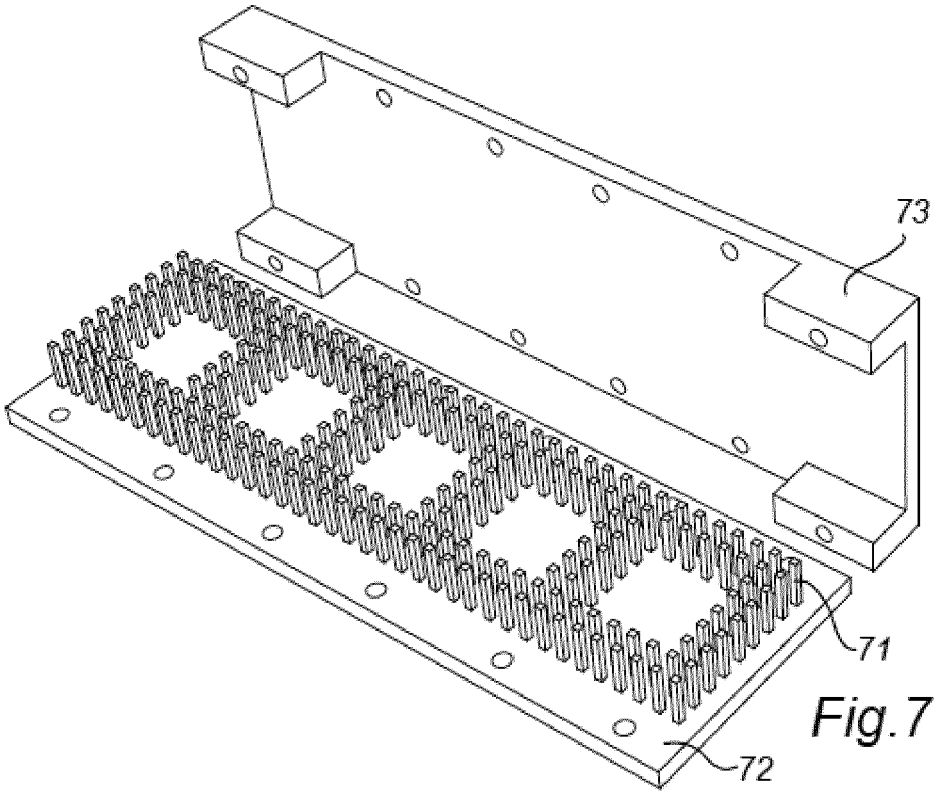
FIGS. 7 and 8 are perspective views of partly disassembled gap waveguide filters in accordance with a further embodiments of the present invention.

FIG. 7 illustrates an exemplary embodiment of a gap waveguide filter, structurally and functionally similar to the one disclosed in [14], said document hereby being incorporated in its entirety by reference. However, contrary to the waveguide filter disclosed in this document, the protruding elements 71 arranged on the conducting layers (here all being arranged on the lower conducting layer for simplicity) are arranged in the way to be discussed in the following. An upper conducting layer 73 is arranged above the protruding elements, in the same way as disclosed in [12]. Thus, this then becomes a groove gap waveguide filter.

Figure 8:
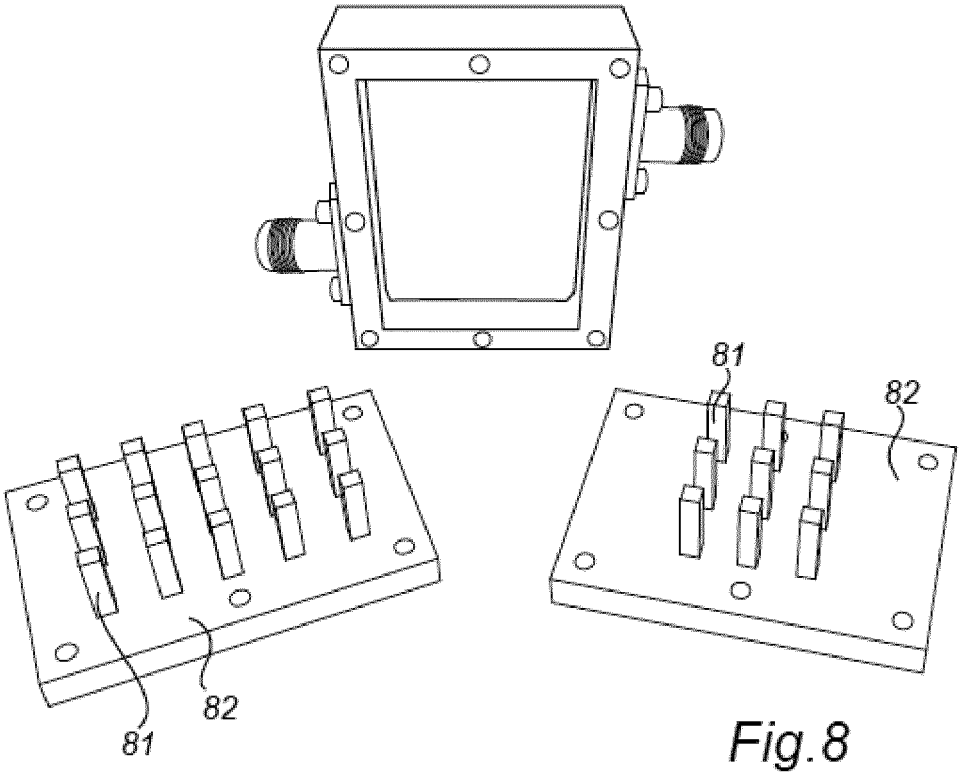

FIG. 8 provides another example of a waveguide filter, which may also be referred to as gap-waveguide-packaged microstrip filter. This filter functionally and structurally resembles the filter disclosed in [15], said document hereby being incorporated in its entirety by reference. However, contrary to the filter disclosed in [15], the filter here is packaged by surfaces having protruding elements, in which protruding elements 81 provided on conducting layers 82 are realized in the above-described way. Two alternative lids, comprising different number and arrangement of the protruding elements 81 are illustrated. Again, the protruding elements are here shown as arranged only on one of the surfaces, for simplicity.

Figure 9A:
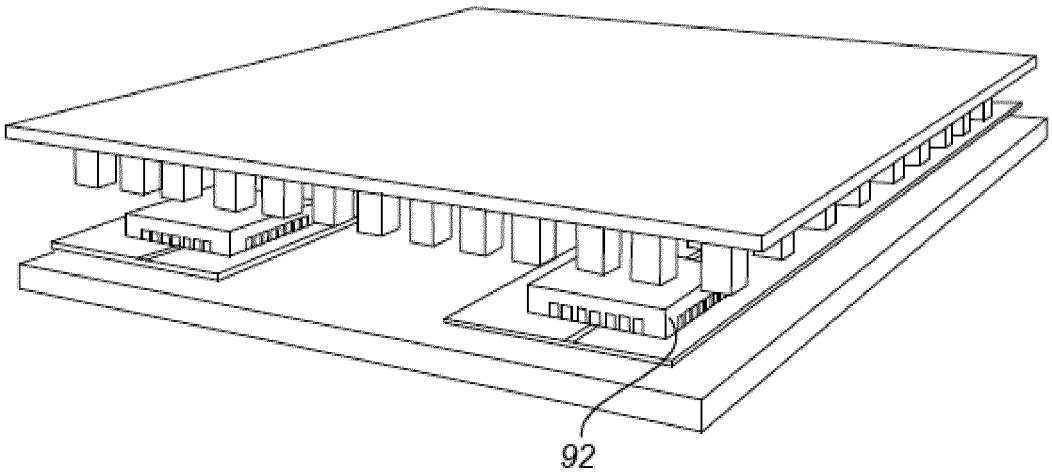
FIG. 9*a* is a schematic perspective view seen from the side and FIG. 9*b* is a side view.
Figure 9B:
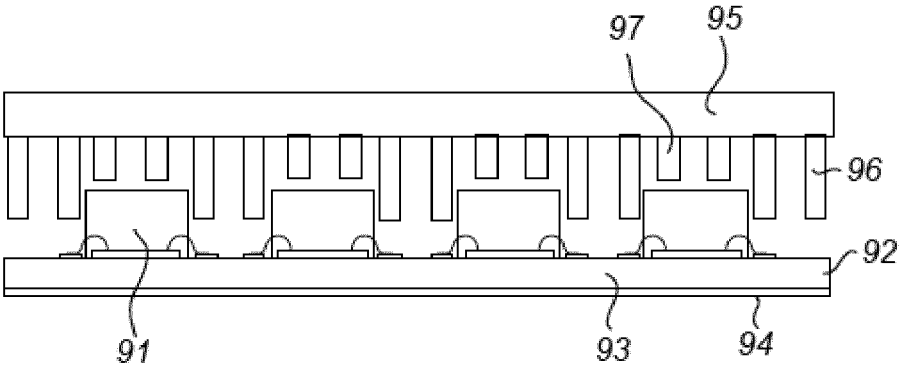

With reference to FIG. 9, an embodiment providing a package for integrated circuit(s) will be discussed. In this example, the integrated circuits are MMIC amplifier modules 91, arranged in a chain configuration on a lower plate 92, here realized as a PCB having an upper main substrate, provided with a lower ground plane 93. A lid is provided, formed by a conducting layer 95, e.g. made of aluminum or any other suitable metal. The lid may be connected to the lower plate 92 by means of a surrounding frame or the like.

The lid as well as the PCB are further provided with protruding elements 96, 97 (in the FIG. 9 shown only on the lid, for simplicity). This is functionally and structurally similar to the package disclosed in [16], said document hereby being incorporated in its entirety by reference. The protruding elements may be of different heights, so that the elements overlying the integrated circuits 91 are of a lower height, and the elements at other areas laterally outside the integrated circuits are of a greater height. Hereby, holes are formed in the surface presented by the protruding elements, in which the integrated circuits are inserted. This packaging is consequently an example of using the gap waveguide as discussed above as a packaging technology, according to the present invention.

All the protruding elements as discussed above, or at least all protruding elements in certain parts or areas of the microwave device, are further arranged and distributed on both the conducting layers, and some preferred realizations of this will now be discussed in more detail.

Hereby, each conducting layer comprises a thereto attached and fixedly connected, and preferably monolithically integrated, set of protruding elements. These two sets are complementary to each other, so that the two sets together form the desired periodical or quasi-periodical pattern forming the stop band, thereby in combination forming the texture to stop wave propagation in a frequency band of operation in other directions than along intended waveguiding paths.

Figure 10:
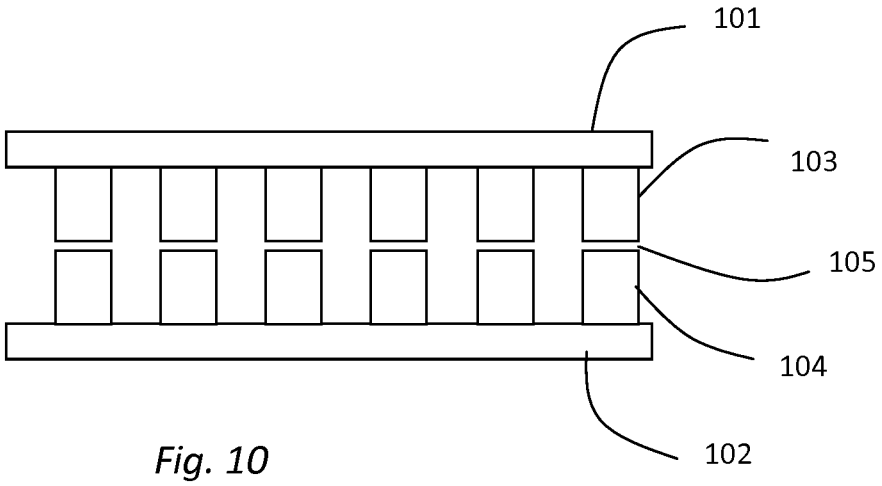
FIGS. 10 and 11 are schematic illustrations of embodiments where the protruding elements are formed by a combination of protruding elements from two sets, in accordance with one line of embodiments of the present invention.
Figure 11:
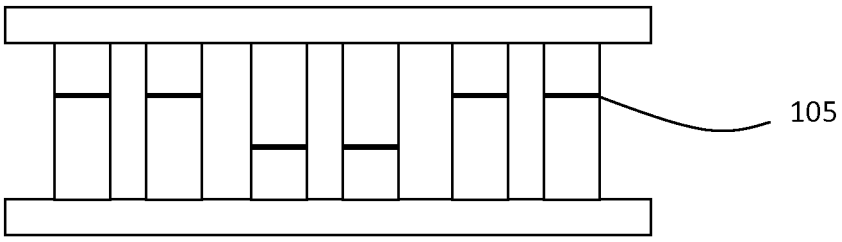

In a first line of embodiment, illustrated in FIGS. 10 and 11, the sets of complementary protruding elements are each formed in said pattern, i.e. each conducting layer comprises a set of protruding elements arranged in the intended periodical or quasi-periodical pattern. However, the protruding elements of each set are each much too low in height to form the stop band. Instead, the protruding elements of the two sets are aligned and arranged overlying each other, so that the protruding elements of the two sets in combination form the required full length of the protruding elements to form the texture.

In the embodiment of FIG. 10, the first conducting layer 101 is provided with a first set of protruding elements 103, and the second conducting layer 102 is provided with a second set of protruding elements 104. At the interface 105 between the protruding elements 103 and 104, a narrow gap may be provided. However, alternatively the protruding elements may be arranged in mechanical and possibly even electrical contact with each other. There will normally not be any need for fixating the protruding elements together. However, should this be desirous, the abutting ends of some or all of the protruding elements may be connected to each other, e.g. by means of soldering, adhesion or the like.

It is normally preferred that the protruding elements of the two sets are all of the same height, so that each protruding element has half the total length of the protruding elements necessary to form the desired stop band. However, sometimes or at certain areas it may be advantageous to use different heights in the two sets. For example, one set may have protruding elements of a first height, and the other set may have protruding elements of a different, second height. However, the height of the protruding elements may also vary within each set. Such an embodiment is illustrated schematically in FIG. 11.

In an alternative line of embodiments, the complementary protruding elements of each set all have the required length of to form the desired stop band, but each set only comprises a subset of the elements forming the intended pattern, so that the complementary sets of protruding elements in combination form the intended pattern.

Figure 12:
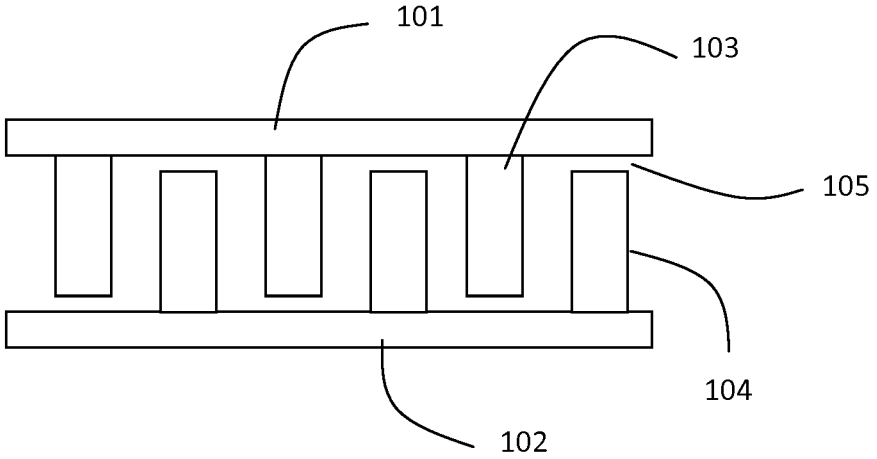
FIG. 12-14 are schematic illustrations of embodiments where the protruding elements are formed by a combination of protruding elements from two sets, in accordance with another line of embodiments of the present invention.

Such an embodiment is illustrated in FIG. 12. Here, a first set of protruding elements 103 is arranged on the upper conducting layer 101, and a second set of protruding elements 104 is arranged on the lower conducting surface. At the interface 105 between the protruding elements 103 and 104 and the overlying/underlying conducting layer to which they are not attached, a narrow gap may be provided. However, alternatively the protruding elements may be arranged in mechanical and possibly even electrical contact with the other conducting layer. There will normally not be any need for fixating the protruding elements to both conducting layers. However, should this be desirous, the ends of some or all of the protruding elements may be connected to the other conducting layer, e.g. by means of soldering, adhesion or the like.

The protruding elements of the two sets are preferably offset in a complementary arrangement, so that protruding elements or rows of protruding elements of the sets are interleaved between each other. However, other ways of dividing the protruding elements in two complementary subsets are also feasible.

Figure 13:
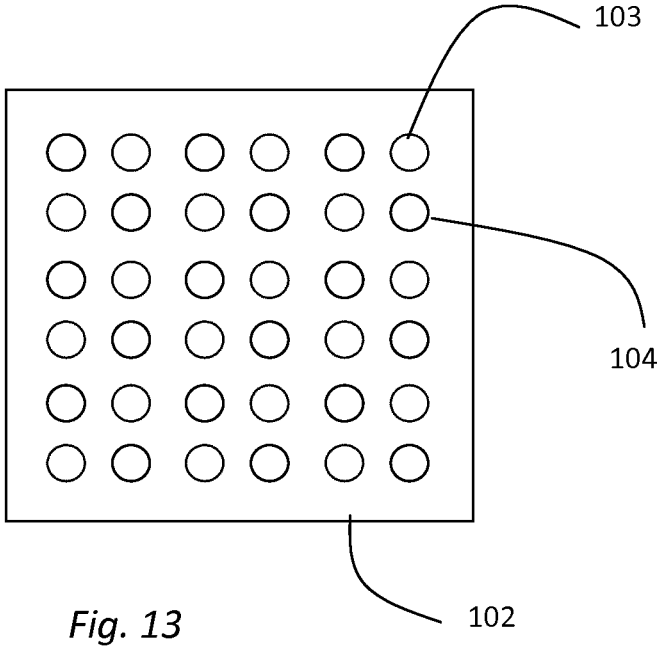

In FIG. 13, an embodiment is schematically illustrated. Here, the protruding elements 104 of the lower conducting surface 102 are arranged in rows, and the protruding elements of each row are offset or staggered in relation to adjacent rows. The complementary subset of protruding elements 103 (illustrated in dashed lines) of the other conducting layer fills the gaps between the protruding elements 104.

Figure 14:
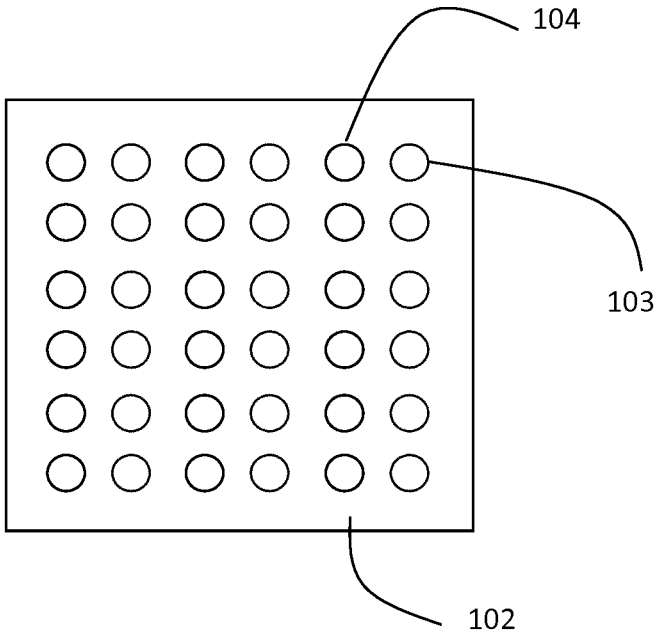

In FIG. 14, an alternative way of separating the protruding elements between the subsets is provided. Here, the each subset contains full rows of protruding elements, but every other row is arranged in the second subset instead of the first subset, so that the rows are interleaved between each other. Thus, the distance between the rows is double the distance between neighboring protruding elements within the rows. Thus, here the distance between each protruding element in each set is greatly increased in one direction, viz. the direction transversal to the rows, but remains the same in one direction, viz. the direction along the rows. Increased separation between the protruding elements dramatically lowers the manufacturing costs.

In experimental simulations, the Ku and V band have been studied, and the obtained stop band been analyzed. The simulations were made on:

a) A conventional gap waveguide, where all the pins (protruding elements) are arranged on the same conducting layer, and where a small gap is provided between the ends of the pins and the overlying second conducting layer. These waveguides are below referred to as "Conventional pin".

b) A gap waveguide in accordance with the FIG. 10 embodiment discussed above. These waveguides are below referred to as "Middle gap pin".

c) A gap waveguide in accordance with the FIGS. 12 and 13 embodiment discussed above. These waveguides are below referred to as "Staggered pin".

When evaluating the stop band for Ku and V band, respectively, the total width and height of the pins were all the same in the embodiments, and the period of the pins were also the same. More specifically, when evaluating the Ku band the width was 3 mm, the height 5 mm and the period 6.5 mm. Simulations were made with a relatively large gap of 1 mm ("Conventional gap"), a relatively narrow gap of 0.13 mm ("Reduced gap"), and a narrow gap of 0.13 mm filled with dielectric ("Dielectric filled reduced gap"), respectively. When evaluating the V band the width was 0.79 mm, the height 1.31 mm and the period 1.71 mm. Simulations were made with a relatively large gap of 0.26 mm ("Conventional gap"), a relatively narrow gap of 0.13 mm ("Reduced gap"), and a narrow gap of 0.13 mm filled with dielectric ("Dielectric filled reduced gap"), respectively.

The results of these experimental simulations are as presented in table 1 and table 2 below.

TABLE 1

Comparison at Ku band

| Stop bandwidth (relative bandwidth: $f_{max}/f_{min}$) | Conventional pin | Middle gap pin | Staggered pin |
|---|---|---|---|
| Conventional gap | 9.3-22 GHz (2.4) | 11-25 GHz (2.3) | 12-22 GHz (1.8) |
| Reduced gap | 5.2-28 GHz (5.4) | 5.6-29 GHz (5.2) | 6.3-28 (4.4) |
| Dielectric filled reduced gap | 3.2-25 GHz (7.8) | 3.3-27 GHz (8.2) | n/a |

TABLE 2

Comparison at V band

| Stop bandwidth (relative bandwidth: $f_{max}/f_{min}$) | Conventional pin | Middle gap pin | Staggered pin |
|---|---|---|---|
| Conventional gap | 35-85 GHz (2.4) | 43-96 GHz (2.2) | 46-84 GHz (1.8) |
| Reduced gap | 30-95 GHz (3.2) | 35-104 GHz (3.0) | 38-94 GHz (2.5) |
| Dielectric filled reduced gap | 20-85 GHz (4.3) | 22-89 GHz (4.0) | n/a |

From this it can be deduced that the provision of gaps at different sides, as in the Staggered pin embodiment, or in the middle, as in the Middle gap pin embodiment, works very well, and provides large and efficient stop bands. It can also be deduced that this works almost as good as conventional gap waveguides, in particular when narrow gaps are used.

The above-discussed exemplary embodiments, such as other realizations of microwave devices in accordance with the invention, can be manufactured and produced in various ways. For example, it is possible to use conventional manufacturing techniques, such as drilling, milling and the like.

It is also possible to use electrical discharge machining (EDM), which may also be referred to as spark machining, spark eroding or die sinking. Hereby, the desired shape is obtained using electrical discharges (sparks), and material is removed from the work piece by a series of rapidly recurring current discharges between two electrodes, separated by a dielectric liquid.

However, it is also possible to use a special technique called die forming (which may also be referred to as coining or multilayer die forming). An equipment and method for manufacturing for such manufacturing of monolithically formed microwave devices and RF parts will next be described in further detail, with reference to FIGS. 15-22.

Figure 15:
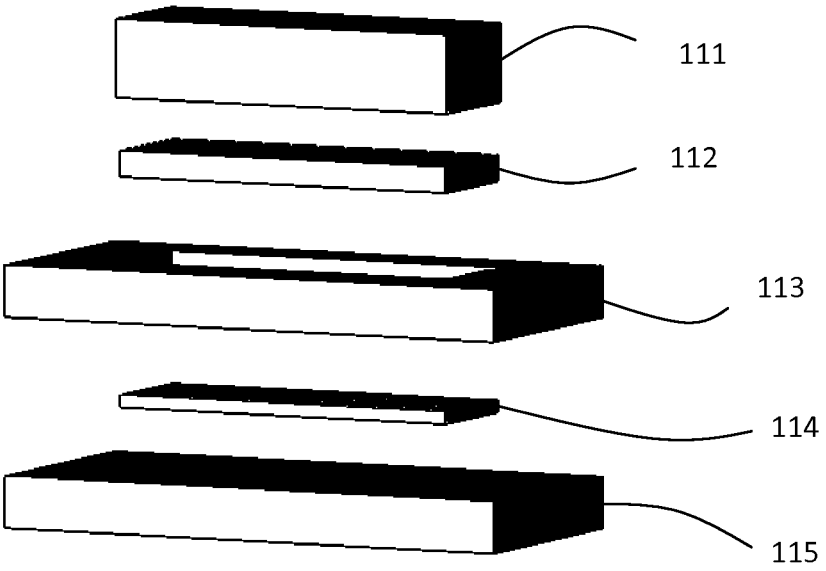
FIG. 15 is a schematic exploded view of a manufacturing equipment in accordance with one embodiment of the present invention.
Figure 16:
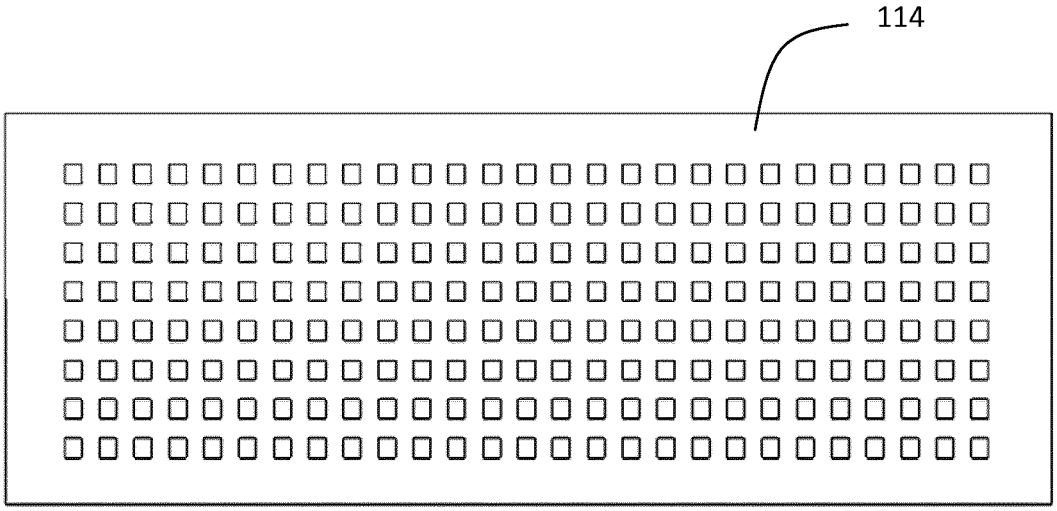
FIG. 16 is a top view of the die forming layer in FIG. 10.

With reference to FIG. 15, a first embodiment of an apparatus for producing an RF part comprises a die comprising a die layer 114 being provided with a plurality of recessions forming the negative of the protruding elements of the RF part. An example of such a die layer 114 is illustrated in FIG. 16. This die layer 114 comprises a grid array of evenly dispersed through-holes, to form a corresponding grid array of protruding elements. The recessions are here of a rectangular shape, but other shapes, such as circular, elliptical, hexagonal or the like, may also be used. Further, the recessions need not have a uniform cross-section over the height of the die layer. The recessions may be cylindrical, but may also be conical, or assume other shapes having varying diameters.

Figure 17:
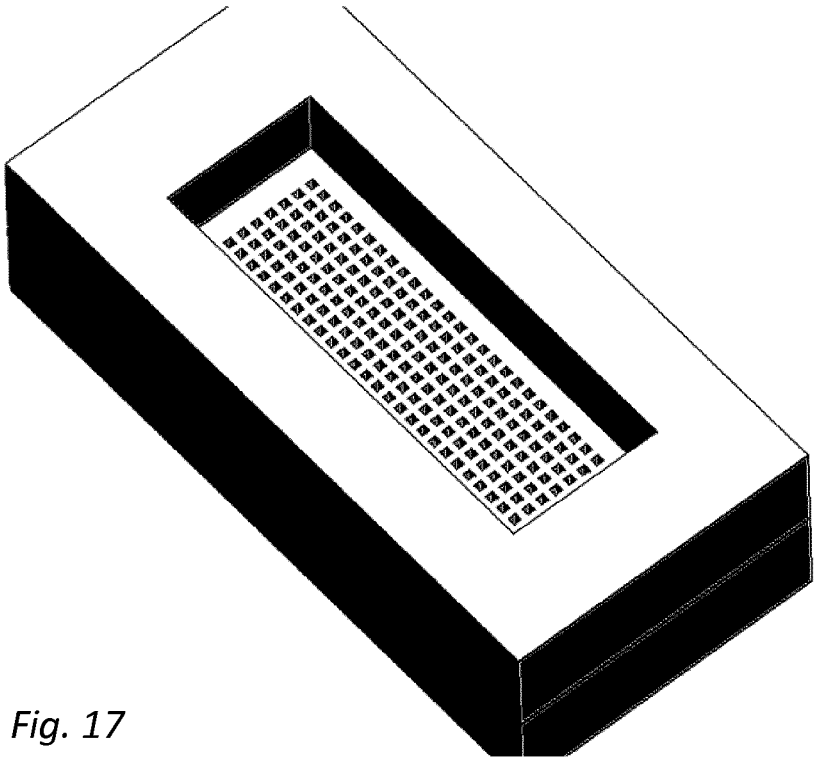
FIG. 17 is a perspective view of the assembled die of FIG. 10.

The die further comprises a collar 113 arranged around said at least one die layer. The collar and die layer are preferably dimensioned to that the die layer has a close fit with the interior of the collar. In FIG. 17, the die layer arranged within the collar is illustrated.

The die further comprises a base plate 115 on which the die layer and the collar are arranged. In case the die comprises through-holes, the base plate will form the bottom of the cavities provided by the through-holes.

Figure 18:
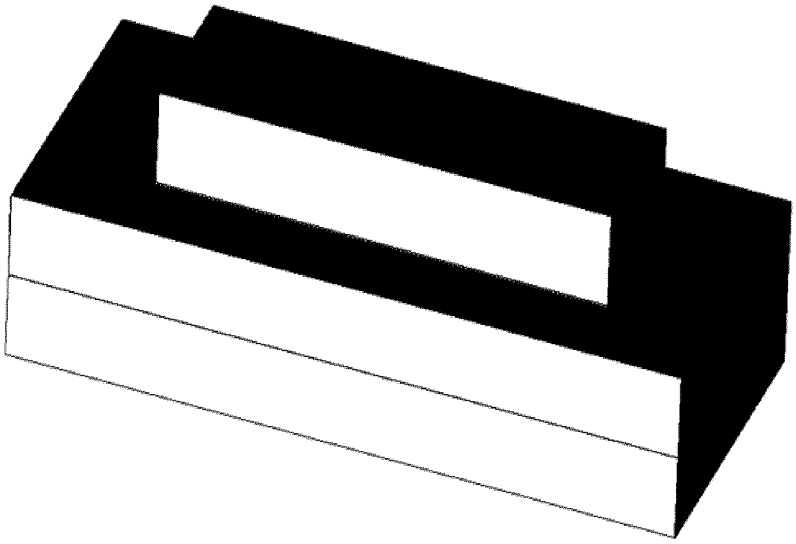
FIG. 18 is a perspective view of the manufacturing equipment of FIG. 15 in an assembled disposition.

A formable piece 112 of material is further arranged within the collar, to be depressed onto the die layer 114. Pressure may be applied directly to the formable piece of material, but preferably, a stamp 111 is arranged on top of the formable piece of material, in order to distribute the pressure evenly. The stamp is preferably also arranged to be insertable into the collar, and having a close fit with the interior of the collar. In FIG. 18, the stamp 111 arranged on top of the formable piece of material in the collar 113 is illustrated in an assembled disposition.

The above-discussed arrangement may be arranged in a conventional pressing arrangement, such as a mechanical or hydraulic press, to apply a pressure on the stamp and the base plate of the die, thereby compressing the formable piece of material to conform with the recessions of the at least one die layer.

The multilayer die press or coining arrangement discussed above can provide protruding elements/pins, ridges and other protruding structures in the formable piece of material having the same height. Through-holes are obtainable e.g. by means of drilling. In case non-through going recessions are used in the die layer, this arrangement may also be used to produce such protruding structures having varying heights.

However, in order to produce protruding structures having varying heights, it is also possible to use several die layers, each having through-holes. Such an embodiment will now be discussed with reference to FIGS. 19-22.

Figure 19:
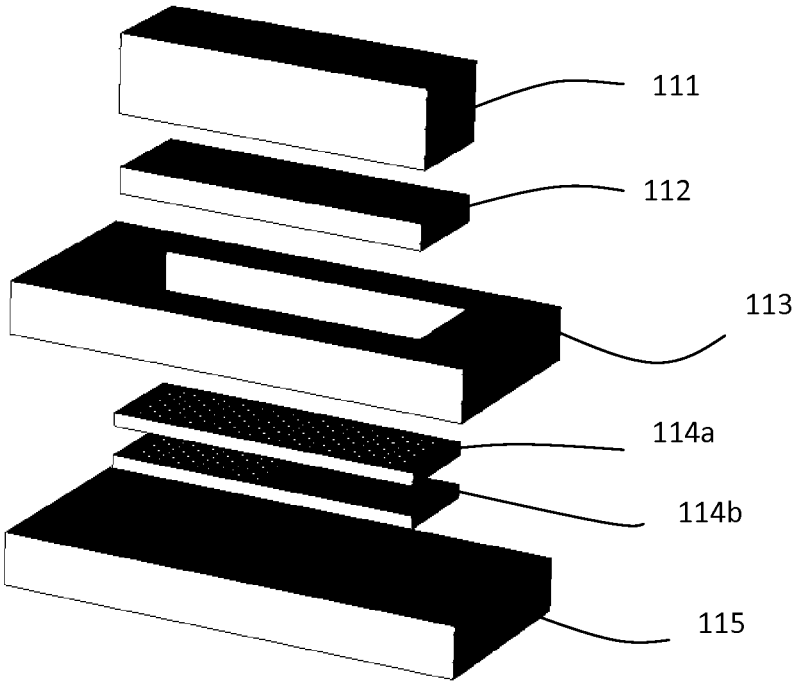
FIG. 19 is a schematic exploded view of a manufacturing equipment in accordance with another embodiment of the present invention.
Figure 20:
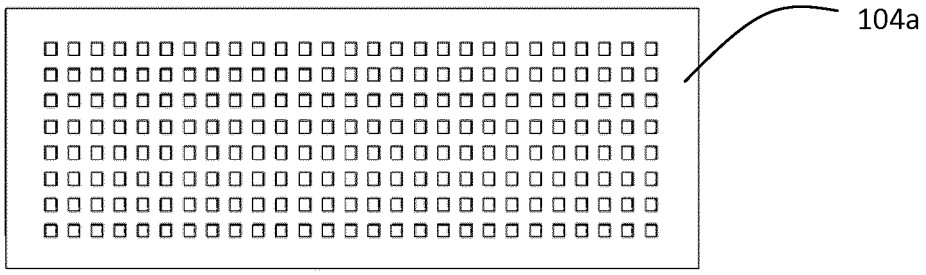
FIGS. 20 and 21 are top views illustrating the two die forming layers in the embodiment of FIG. 19.
Figure 21:
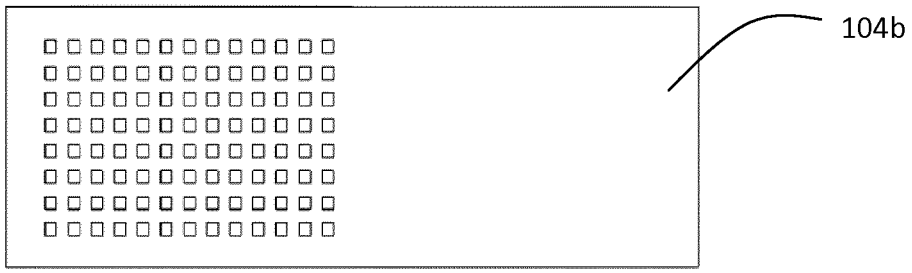
Figure 22:
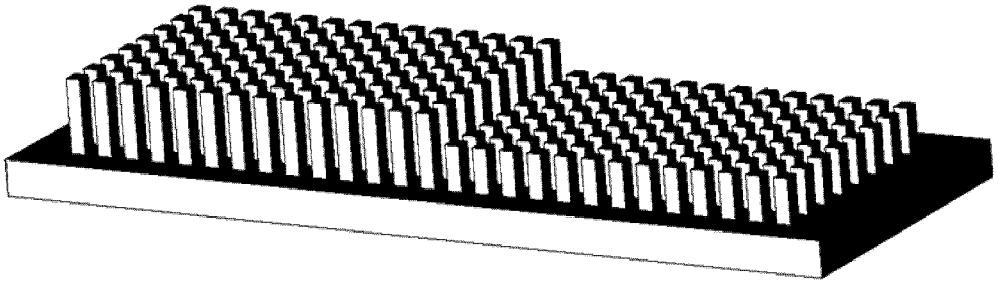
FIG. 22 is a perspective view showing an RF part producible by the manufacturing equipment of FIG. 19.

With reference to the exploded view of FIG. 19, this apparatus comprises the same layers/components as in the previously discussed embodiment. However, here two separate die layers 114*a* and 114*b* are provided. Examples of such die layers are illustrated in FIGS. 20 and 21. The die layer 114*a* (shown in FIG. 20) being arranged closest to the formable piece of material 112 is provided with a plurality of through-holes. The other die layer 114*b* (shown in FIG. 21), being farther from the formable piece of material 112 comprises fewer recessions. The recessions of the second die layer 114*b* are preferably correlated with corresponding recessions in the first die layer 114*a*. Hereby, some recessions of the first die layer will end at the encounter with the second die layer, to form short protruding elements, whereas some will extend also within the second die layer, to form high protruding elements. Hereby, by adequate formation of the die layer, it is relatively simple to produce protruding element of various heights, An example of an RF part having protruding elements of varying heights, in accordance with the embodiments of the die layers illustrated in FIGS. 20 and 21, is shown in FIG. 22.

In the foregoing, the stamp 111, collar 113, die layer(s) 114 and base plate 115 are exemplified as separate elements, being detachably arranged on top of each other. However, these elements may also be permanently or detachably connected to each other, or formed as integrated units, in various combinations. For example, the base plate 115 and collar 113 may be provided as a combined unit, the die layer may be connected to the collar and/or the base plate, etc.

The pressing in which pressure is applied to form the formable material in conformity with the die layer may be performed at room temperature. However, in order to facilitate the formation, especially when relatively hard materials are used, heat may also be applied to the formable material. For example if aluminum is used as the formable material, the material may be heated to a few hundred degrees C., or even up to 500 deg. C. If tin is used, the material may be heated to 100-150 deg. C. By applying heat, the forming can be faster, and less pressure is needed.

To facilitate removal of the formable material from the die/die layer after the forming, the recessions can be made slightly conical or the like. It is also possible to apply heat or cold to the die and formable material. Since different materials have different coefficients of thermal expansion, the die and formable material will contract and expand differently when cold and or heat is applied. For example, tin has a much lower coefficient of thermal expansion than steel, so if the die is made of steel and the formable material of tin, removal will be much facilitated by cooling. Cooling may e.g. be made by dipping or in other way exposing the die and/or formable material to liquid nitrogen.

Some examples of microwave devices and RF parts have been discussed in the foregoing. However, many other types of e.g. per se known RF parts and microwave devices can be produced by using a pattern of protruding elements made by complementary subsets arranged on the two conductive layers, as discussed above.

For example, it is also possible to produce RF parts to form flat array antennas with this technology. For example, antennas structurally and functionally resembling the antenna disclosed in [12] and/or the antenna discussed in [13] can be cost-effectively produced in this way, said documents hereby being incorporated in its entirety by reference. One or several of the waveguide layers of such an antenna may be made as a waveguide as discussed in the foregoing, without any substrate between the two metal ground planes, and with protruding fingers/elements extending between the two conducting layers, formed by waveguide elements with bases attached to the substrate. Then, the conventional via holes, as discussed in [13], will instead be fingers, such as metal pins or the like, forming a waveguide cavity between the two metal plates, within each unit cell of the whole antenna array.

The RF part may also be a gap waveguide filter, structurally and functionally similar to the one disclosed in [14], said document hereby being incorporated in its entirety by reference. However, contrary to the waveguide filter disclosed in this document, the protruding fingers/elements are now then arranged on a lower conducting layer by use of the above-discussed waveguide elements. Another example of a waveguide filter producible in this way is the filter disclosed in [15], said document hereby being incorporated in its entirety by reference.

The RF part may also be used to form a connection to and from an integrated circuit, and in particular MMICs, such as MMIC amplifier modules.

Further, grids of protruding fingers may also be provided by waveguide elements of the general type discussed above, for use e.g. for packaging. Such grids may e.g. be formed by providing waveguide elements having one, two or more rows of protruding fingers side-by-side on a substrate.

The invention has now been described with reference to specific embodiments. However, several variations of the technology of the waveguide and RF packaging in the antenna system are feasible. For example, a multitude of different waveguide elements useable to form various types of waveguides and other RF parts are feasible, either for use as standardized elements, or for dedicated purposes or even being customized for certain uses and applications. Further, even though assembly by means of pick-and-place equipment is preferred, other types of surface mount technology placement may also be used, and the waveguide elements may also be assembled in other ways. Further, the here disclosed realization of protruding elements can be used in many other antenna systems and apparatuses in which conventional gap waveguides have been used or could be contemplated. Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

REFERENCES

[1] J. Hirokawa and M. Ando, "Efficiency of 76-GHz post-wall waveguide-fed parallel-plate slot arrays," *IEEE Trans. Antenna Propag.*, vol. 48, no. 11, pp. 1742-1745, November 2000.

[2] Per-Simon Kildal, "Waveguides and transmission lines in gaps between parallel conducting surfaces", patent application No. PCT/EP2009/057743, 22 Jun. 2009.

[3] P.-S. Kildal, E. Alfonso, A. Valero-Nogueira, E. Rajo-Iglesias, "Local metamaterial-based waveguides in gaps between parallel metal plates," *IEEE Antennas and Wireless Propagation letters*, vol. 8, pp. 84-87, 2009.

[4] P.-S. Kildal, A. Uz Zaman, E. Rajo-Iglesias, E. Alfonso and A. Valero-Nogueira, "Design and experimental verification of ridge gap waveguides in bed of nails for parallel plate mode suppression," *IET Microwaves, Antennas & Propagation*, vol. 5, iss. 3, pp. 262-270, March 2011.

[5] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[6] P.-S. Kildal, "Three metamaterial-based gap waveguides between parallel metal plates for mm/submm waves", 3rd *European Conference on Antennas and Propagation,* Berlin, March 2009.

[7] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[8] A. Valero-Nogueira, J. Domenech, M. Baquero, J. I. Herranz, E. Alfonso, and A. Vila, "Gap waveguides using a suspended strip on a bed of nails," *IEEE Antennas and Wireless Propag. Letters*, vol. 10, pp. 1006-1009, 2011.

[9] E. Pucci, E. Rajo-Iglesias, P.-S. Kildal, "New Microstrip Gap Waveguide on Mushroom-Type EBG for Packaging of Microwave Components", IEEE Microwave and Wireless Components Letters, Vol. 22, No. 3, pp. 129-131, March 2012.

[10] E. Pucci, E. Rajo-Iglesias, J.-L. Vasquuez-Roy, P.-S. Kildal, "Planar Dual-Mode Horn Array with Corporate-Feed Network in Inverted Microstrip Gap Waveguide", accepted for publication in IEEE Transactions on Antennas and Propagation, March 2014.

[11] E. Pucci, A. U. Zaman, E. Rajo-Iglesias, P.-S. Kildal, "New low loss inverted microstrip line using gap waveguide technology for slot antenna applications", 6th European Conference on Antennas and Propagation EuCAP 2011, Rome, 11-15 Apr. 2011.

[12] E. Pucci, E. Rajo-Iglesias, J.-L. Vazquez-Roy and P.-S. Kildal, "Design of a four-element horn antenna array fed by inverted microstrip gap waveguide", 2013 IEEE International Symposium on Antennas and Propagation (IEEE AP-S 2013), Orlando, USA, Jul. 7-12, 2013.

[13] Seyed Ali Razavi, Per-Simon Kildal, Liangliang Xiang, Haiguang Chen, Esperanza Alfonso, "Design of 60 GHz Planar Array Antennas Using PCB-based Microstrip-Ridge Gap Waveguide and SIW", 8th European Conference on Antennas and Propagation EuCAP 2014, The Hague, The Netherlands, 6-11 Apr. 2014.

[14] A. U. Zaman, A. Kishk, and P.-S. Kildal, "Narrow-band microwave filter using high Q groove gap waveguide resonators without sidewalls", IEEE Transactions on Components, Packaging and Manufacturing Technology, Vol. 2, No. 11, pp. 1882-1889, November 2012.

[15] A. Algaba Brazalez, A. Uz Zaman, P.-S. Kildal, "Improved Microstrip Filters Using PMC Packaging by Lid of Nails", IEEE Transactions on Components, Packaging and Manufacturing Technology, Vol. 2, No. 7, July 2012.

[16] A. U. Zaman, T. Vukusic, M. Alexanderson, P.-S. Kildal, "Gap Waveguide PMC Packaging for Improved Isolation of Circuit Components in High Frequency Microwave Modules", IEEE Transactions on Components, Packaging and Manufacturing Technology, Vol. 4, Issue 1, p. 16-25, 2014.

The invention claimed is:

1. A microwave device comprising two conducting layers arranged with a gap there between, and protruding elements arranged in a periodically or quasi-periodically pattern and fixedly connected to at least one of said conducting layers, thereby forming a texture to stop wave propagation in a frequency band of operation in other directions than along intended waveguiding paths, wherein at least one of the conducting layers comprises a waveguiding path, the waveguiding paths comprising at least one of a conducting ridge and a groove with conducting walls, and wherein the protruding elements are arranged along at least one row on each side of the waveguiding paths, wherein each of said conducting layers comprises a thereto fixedly connected set of complementary protruding elements, said sets in combination forming said texture, the sets of complementary protruding elements being each formed in said pattern and arranged in alignment and overlying each other, the complementary protruding elements of each set forming part of the full length of each protruding element of the pattern, and wherein the complementary protruding elements of each set being arranged in contact with each other or with a small gap there between.

2. The microwave device of claim 1, wherein the sets of complementary protruding elements are formed in said pattern and arranged in alignment with each other, and wherein the protruding elements of both sets are all of the same length, said length being half the length of the full-length protruding elements of the texture.

3. The microwave device of claim 1, wherein the protruding elements in at least one of the conducting layers are arranged to at least partly surround a cavity between said conducting layers, said cavity thereby forming said groove functioning as a waveguide.

4. The microwave device according to claim 1, wherein the sets of protruding elements are monolithically formed on said conducting layers.

5. The microwave device of claim 1, wherein all protruding elements of each of said conducting layers are connected electrically to each other at their bases at least via said conductive layer on which they are fixedly connected.

6. The microwave device of claim 1, wherein the waveguiding path is a conducting ridge.

7. The microwave device of claim 6, wherein the waveguiding path is for a single-mode wave.

8. The microwave device of claim 1, wherein each of the protruding elements has a maximum width dimension in the range 0.05-1.0 mm.

9. The microwave device of claim 8, wherein each of the protruding elements has a maximum width dimension in the range 0.1-0.5 mm.

10. The microwave device according to claim 1, wherein the two conducting layers are connected together for rigidity by a mechanical structure at some distance outside the region with guided waves.

11. The microwave device of claim 10, wherein the mechanical structure is integrally and monolithically formed on at least one of the conducting materials defining one of the conducting layers.

12. The microwave device of claim 1, wherein the protruding elements are in form of posts or pins, the posts/pins having a circular or rectangular cross-section.

13. The microwave device of claim 1, wherein a full length of the protruding elements is greater than a width and thickness of the protruding elements.

14. The microwave device of claim 13, wherein the full length of the protruding elements is greater than double the width and thickness of the protruding elements.

15. The microwave device according to claim 1, wherein at least one of the conducting layers is provided with at least one opening, in the form of rectangular slot(s), said opening(s) allowing radiation to be transmitted to and/or received from said microwave device.

16. The microwave device according to claim 1, wherein the protruding elements have maximum cross-sectional dimensions of less than half a wavelength in air at an operating frequency, and/or wherein the protruding elements in the texture stopping wave propagation are spaced apart by a spacing being smaller than half a wavelength in air at the operating frequency.

17. A microwave device comprising two conducting layers arranged with a gap there between, and protruding elements arranged in a periodically or quasi-periodically pattern and fixedly connected to at least one of said conducting layers, thereby forming a texture to stop wave propagation in a frequency band of operation in other directions than along intended waveguiding paths, wherein at least one of the conducting layers comprises a waveguiding path, the waveguiding paths comprising at least one of a conducting ridge and a groove with conducting walls, and wherein the protruding elements are arranged along at least one row on each side of the waveguiding paths, wherein each of said conducting layers comprises a thereto fixedly connected set of complementary protruding elements, said sets in combination forming said texture, the sets of complementary protruding elements being arranged in an offset complementary arrangement, the protruding elements of one set thereby being arranged in between the protruding elements of the other set.

18. The microwave device of claim 17, wherein the sets of complementary protruding elements are arranged in an offset complementary arrangement, the protruding elements of each set being arranged in rows, wherein the protruding elements in each row being arranged in a staggered disposition in relation to adjacent rows, the protruding elements of the sets thereby being interleaved between each other both within each row.

19. The microwave device of claim 17, wherein the sets of complementary protruding elements are arranged in an offset complementary arrangement, the protruding elements of each set being arranged in rows, wherein the distance between the rows are double the distance between neighboring protruding elements within the rows, the rows of the sets thereby being interleaved between each other.

20. The microwave device of claim 17, wherein at least some of the protruding elements are in mechanical contact with said other conducting layer.

21. The microwave device of claim 20, wherein all of the protruding elements are in mechanical contact with the other conducting layer.

22. A microwave device comprising two conducting layers arranged with a gap there between, and protruding elements arranged in a periodically or quasi-periodically pattern and fixedly connected to at least one of said conducting layers, thereby forming a texture to stop wave propagation in a frequency band of operation in other directions than along intended waveguiding paths, wherein at least one of the conducting layers comprises a waveguiding path, the waveguiding paths comprising at least one of a conducting ridge and a groove with conducting walls, and wherein the protruding elements are arranged along at least one row on each side of the waveguiding paths, wherein each of said conducting layers comprises a thereto fixedly connected set of complementary protruding elements, said sets in combination forming said texture, the sets of complementary protruding elements being either each formed in said pattern and arranged in alignment and overlying each other, the complementary protruding elements of each set forming part of the full length of each protruding element of the pattern, or the sets of complementary protruding elements being arranged in an offset complementary arrangement, the protruding elements of one set thereby being arranged in between the protruding elements of the other set, wherein at least some of the protruding elements are in mechanical contact with said other conducting layer.

23. The microwave device of claim 22, wherein all of the protruding elements are in mechanical contact with the other conducting layer.

* * * * *